US010562679B2

(12) United States Patent
Wisniewski

(10) Patent No.: US 10,562,679 B2
(45) **Date of Patent: *Feb. 18, 2020**

(54) TAMPER-EVIDENT CLOSING ELEMENT AND RECEIVING STRUCTURE

(71) Applicant: AptarGoup, Inc., Crystal Lake, IL (US)

(72) Inventor: John Wisniewski, Wauwatosa, WI (US)

(73) Assignee: APTARGROUP, INC., Crystal Lake, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/222,433

(22) Filed: Dec. 17, 2018

(65) Prior Publication Data

US 2019/0119009 A1 Apr. 25, 2019

Related U.S. Application Data

(63) Continuation of application No. 15/026,513, filed as application No. PCT/US2013/068209 on Nov. 4, 2013, now Pat. No. 10,196,179.

(51) Int. Cl.
*B65D 41/34* (2006.01)
*B65D 55/02* (2006.01)

(52) U.S. Cl.
CPC ..... *B65D 41/3442* (2013.01); *B65D 41/3409* (2013.01); *B65D 55/024* (2013.01);
(Continued)

(58) Field of Classification Search
CPC ..... B65D 41/3442; B65D 41/3447; B65D 41/3352; B65D 41/3457; B65D 41/3495;
(Continued)

(56) References Cited

U.S. PATENT DOCUMENTS 3,463,341 A 8/1969 Fields
3,501,083 A * 3/1970 Lake ..... B65D 85/324 206/521.1

(Continued)

FOREIGN PATENT DOCUMENTS

CA 2014709 A1 5/1991
CA 2469654 A1 6/2004

(Continued)

*Primary Examiner* — Steven A. Reynolds
*Assistant Examiner* — Javier A Pagan
(74) *Attorney, Agent, or Firm* — Wood, Phillips, Katz, Clark & Mortimer

(57) ABSTRACT

A combination of a closing element (28) and a receiving structure (24) is provided wherein the closing element (28) and receiving structure (24) are in an initially assembled orientation which prevents, but which can be subsequently operated to permit, communication through the receiving structure (24). The receiving structure (24) includes at least one laterally projecting shear member (40) and a spout (30) defining (A) an access passage (32). The closing element (28) has an aperture (78) for receiving a shear member (40) of the receiving structure (24). At least one frangible bridge (78) extends across a portion of the aperture (74) for being severed by the shear member (40) during relative rotation between the closing element (28) and the receiving structure (24).

12 Claims, 18 Drawing Sheets

(52) U.S. Cl.
CPC ..... *B65D 2101/003* (2013.01); *B65D 2101/0046* (2013.01); *B65D 2251/02* (2013.01); *B65D 2251/04* (2013.01)

(58) Field of Classification Search
CPC ..... B65D 41/3409; B65D 41/3414; B65D 55/024
See application file for complete search history.

(56) References Cited

U.S. PATENT DOCUMENTS

| | | | | |
|---|---|---|---|---|
| 4,299,330 | A | 11/1981 | Walter | |
| 4,609,115 | A | 9/1986 | Moore et al. | |
| 5,105,961 | A | 4/1992 | Noren et al. | |
| 5,692,628 | A | 12/1997 | Montgomery et al. | |
| 5,720,402 | A | 2/1998 | May | |
| 5,819,965 | A | 10/1998 | King et al. | |
| 6,105,802 | A | 8/2000 | French et al. | |
| 7,077,278 | B2 * | 7/2006 | Dubach ..... | B65D 41/3409 215/252 |
| 7,097,058 | B2 | 8/2006 | Wellman et al. | |
| 7,677,422 | B2 | 3/2010 | Lee | |
| 10,196,179 | B2 * | 2/2019 | Wisniewski ..... | B65D 41/3442 |
| 2004/0251228 | A1 * | 12/2004 | Long, Jr. ..... | B65D 41/3447 215/252 |
| 2015/0353242 | A1 | 12/2015 | Santarelli et al. | |

FOREIGN PATENT DOCUMENTS

| | | | |
|---|---|---|---|
| CA | 2286584 | C | 8/2006 |
| CA | 2478524 | C | 12/2008 |
| CA | 2677155 | A1 | 7/2009 |
| CA | 2750878 | A1 | 8/2010 |
| CA | 2785730 | A1 | 7/2011 |
| DE | 2755548 | A1 | 6/1979 |
| GB | 1181048 | | 2/1970 |
| GB | 2172273 | B | 12/1988 |
| JP | 2004131157 | A | 4/2004 |
| WO | 2005009854 | A1 | 2/2005 |
| WO | 2012175663 | A1 | 12/2012 |
| WO | 2013119781 | A | 8/2013 |
| WO | 2013147599 | | 10/2013 |

* cited by examiner

TAMPER-EVIDENT CLOSING ELEMENT AND RECEIVING STRUCTURE

TECHNICAL FIELD

This invention relates to a tamper-evident combination (e.g., assembly) for initially preventing, but subsequently permitting, communication between the exterior and interior of a system.

BACKGROUND OF THE INVENTION AND TECHNICAL PROBLEMS POSED BY THE PRIOR ART

Closures are employed to selectively prevent or permit communication between the exterior and interior of a system (e.g., machine, equipment, containment system (including bottles and pouches), etc.) through an opening in the system. A typical closure includes a (1) receiving structure (e.g., a body, base, fitment, etc.) at an opening to the system interior, and (2) a closing element (e.g., a lid, cover, overcap, etc.).

The receiving structure can typically be either (1) a separate structure that (a) can be attached at such a system opening, and (b) defines at least one access passage through the receiving structure for communicating through such a system opening with the interior of such a system, or (2) an integral structure that is a unitary portion of such a system and that defines at least one access passage through the integral structure such that the access passage functions as the opening, per se, to the system.

The closing element typically accommodates movement relative to the receiving structure access passage between (1) a fully closed position occluding the access passage, and (2) an open position at least partially exposing the access passage.

The inventor of the present invention has determined that it would be desirable to provide an improved assembly of a closing element and receiving structure which would readily provide the user with an indication or evidence of a prior attempt to open or tamper with the assembly.

It would additionally be beneficial if such an improved assembly could be relatively easily operated, without requiring an unusually complex manipulation or series of manipulations.

It would also be beneficial if the components of such an improved assembly could be relatively easy to manufacture and assemble.

Further, it would be desirable if such an improved assembly could be opened without generating smaller, separate waste pieces.

SUMMARY OF THE INVENTION

The present invention provides a combination of a closing element and a receiving structure which together in an initially assembled orientation prevent, but can be subsequently operated to permit, communication through the receiving structure.

The receiving structure includes (A) at least one laterally projecting shear member, and (B) a spout defining an access passage (i.e., at least one access passage).

The closing element has an open end into which the receiving structure spout extends to accommodate relative rotation between the closing element and receiving structure.

The closing element also includes an aperture for initially receiving the shear member when the closing element and receiving structure are in the initially assembled orientation.

The closing element also includes at least one frangible bridge extending across a portion of the aperture for being severed by the shear member during relative rotation between the closing element and receiving structure.

In a preferred embodiment, the spout also defines one of a cam and a cam follower. In that preferred embodiment, the closing element also includes a skirt that defines (1) the open end of the closing element, (2) the other of the cam and cam follower for engaging the one of the cam and cam follower on the receiving structure spout to effect relative axial movement between the receiving structure and the closing element, and (3) the aperture between the closing element open end and the other of the cam and cam follower.

The invention, and particularly the preferred embodiment of the invention, provides various operational advantages. The operational advantages are especially effective and desirable in the assembly components when they are molded from polyethylene and/or polypropylene.

It should be appreciated that the invention may include all or none of the above-described features, or include only one or more of the above-described features, or include any combination of the above-described features. Furthermore, other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENTS

Figure 1:
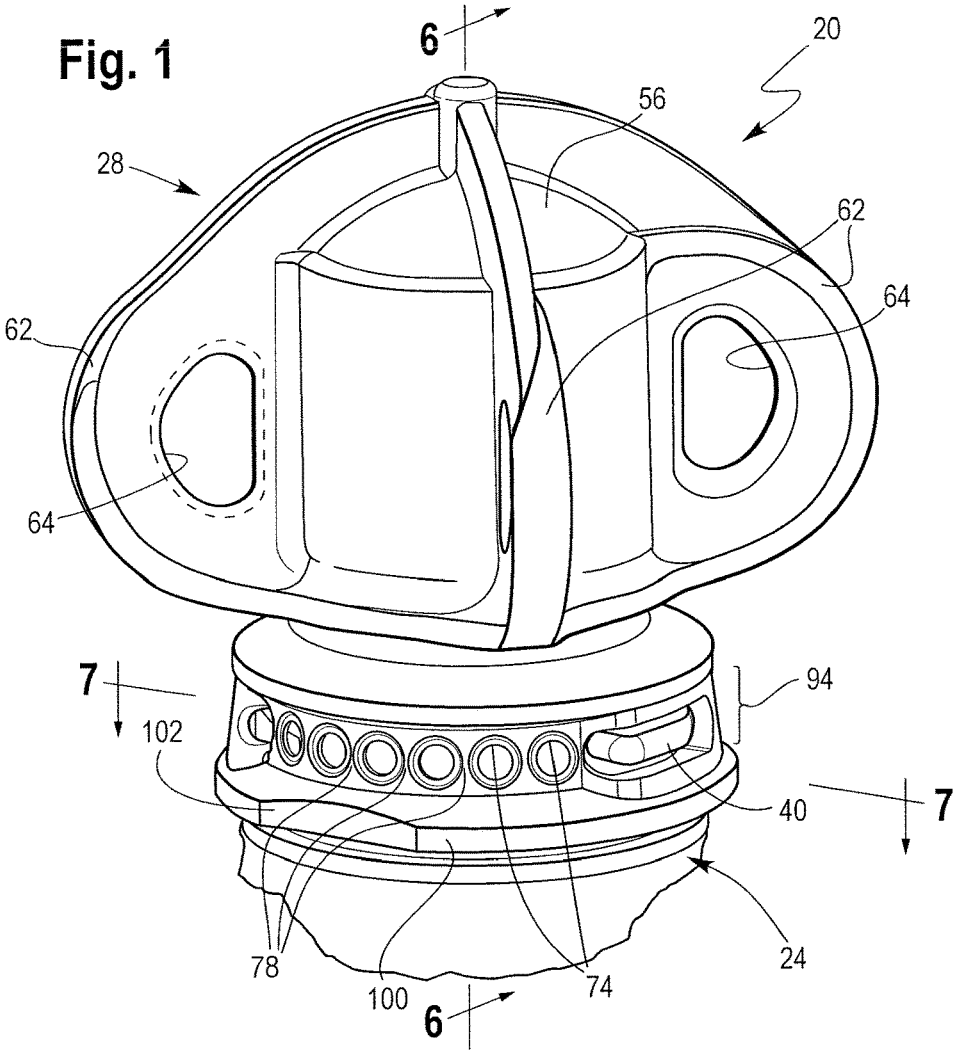
FIG. 1 is a fragmentary, isometric view of a closure, comprising the combination of a closing element and a receiving structure, according to a presently preferred embodiment of the present invention, and the isometric view is taken from slightly above the top of the closure to show the closure components in an initially assembled orientation (that defines a fully closed condition) as may be initially provided by the manufacturer for subsequent installation on a system (e.g., a container (not illustrated) in which a product is stored or can be stored)

While this invention is susceptible of embodiment in different forms, this specification and the accompanying drawings disclose only some specific embodiments as examples of the invention. The invention is not intended to be limited to the embodiments so described, and the scope of the invention will be pointed out in the appended claims.

For ease of description, many figures illustrating the invention show a presently preferred embodiment of a closure in the typical orientation that the closure would have when installed at the opening of a system, such as a machine, equipment, or an upright containment system (which may be, for example, a flexible pouch, bottle, or other container), and terms such as upper, lower, horizontal, etc., are used with reference to this orientation. It will be understood, however, that the closure may be manufactured, stored, transported, used, and sold in an orientation other than the orientation described.

The closure is suitable for use with a variety of conventional or special systems, the details of which, although not fully illustrated or described, would be apparent to those having skill in the art and an understanding of such systems. The particular systems, per se, that are described herein form no part of, and therefore are not intended to limit, the broad aspects of the present invention.

The illustrated embodiment of the closure will typically be used on a system in the form of a containment system that contains a material or substance (e.g., a product such as a lotion, fluent food, or drink substance) that can be dispensed, or otherwise removed, from the system through the opened closure. The product may be, for example, a fluent material such as a liquid, cream, powder, slurry, or paste. If the system is a container, and if the container and closure are large enough, then the product could also be non-fluent, discrete pieces of material (e.g., food products such as nuts, candies, crackers, cookies, etc., or non-food products including various items, particles, granules, etc.) which can be removed through an open closure by hand from a container, or scooped out of a container, or ladled out of a container, or poured out of a container. Such materials may be, for example, a food product, a personal care product, an industrial product, a household product, or other types of products. Such materials may be for internal or external use by humans or animals, or for other uses (e.g., activities involving medicine, manufacturing, commercial or household maintenance, construction, agriculture, etc.).

An embodiment of a closure incorporating the present invention is illustrated in the FIGS. 1-11B wherein the closure is designated generally by reference number 20. In the illustrated embodiment, the closure 20 is provided in the form of a separate closure which is especially suitable for being attached to a system (not illustrated) in the form of a containment system that would typically contain contents such as a product or products consisting of articles or fluent material. Such a containment system could be a collapsible, flexible pouch, or may be a generally rigid container (which may have somewhat flexible, resilient walls), such as a bottle or tank.

The system may be some other system which may include, or be part of, for example, a medical device, processing machine, dispenser, reservoir on a machine, etc., wherein the system has an opening to the system interior. The system, per se, such as a bottle, pouch, or other containment system, or other type of system per se, does not form a part of the broadest aspects of the present invention, per se. The system may have any configuration suitable for the intended use.

If the system is a containment system such as a container, then the containment system, or a portion thereof, may be made from a material suitable for the intended application (e.g., a thin, flexible material for a pouch wherein such a material could be a polyethylene terephthalate (PET) film or a polyethylene film, or a thicker, less flexible material for a bottle wherein such a less flexible material could be injection-molded polyethylene or polypropylene).

In applications wherein the closure 20 is mounted to a container such as a bottle or pouch (not illustrated), it is contemplated that typically, after the closure manufacturer makes the closure (e.g., by molding components of the closure 20 from a thermoplastic polymer and assembling them together in an initially assembled orientation defining a fully closed condition), the closure manufacturer will then ship the closed closure 20 to a containment system filler facility at another location where the container is either manufactured or otherwise provided, and where the container is filled with a product. However, for some applications, the components of the closure 20 could be shipped by the manufacturer in an unassembled condition to the filler facility.

If the container is a collapsible pouch (not illustrated), then the closure 20 may include a suitable conventional or special fitment portion (not illustrated in the Figures) that can be attached to the pouch as the pouch is being made and filled, or as the pouch is being made but before the pouch is subsequently filled through a base of the unassembled closure or through open regions of the pouch walls that are later sealed closed.

In the illustrated embodiment, the closure 20 is preferably provided as an assembly of a closing element 28 and receiving structure 24 that together define an article (i.e., the closure 20) for being attached to a system. The illustrated preferred embodiment of the closure 20 is especially suitable for being non-removably attached (e.g., mounted or installed) on a system that is a containment system in the form of a pouch or bottle. However, it will be appreciated that in some applications (not illustrated), it may be desirable for the closure 20 to be attached to a system in a manner that would allow a user to remove the closure 20 from the system. Further, it may be desirable for the closure (or at least the receiving structure of the closure) to be formed as an integral, unitary part, or extension, of the system (e.g., a pouch or bottle) wherein such a unitary part or extension also (i.e., simultaneously) defines an end structure (or other portion) of the system, per se.

The illustrated embodiment of the closure 20, if initially manufactured and provided separately from the containment system, is adapted to be subsequently attached to a containment system at an opening in the system which provides access from the exterior environment to the containment system interior and to the contents (e.g., a product contained therein) after a portion of the closure (e.g., the closing element 28) is opened as described hereinafter.

Where the system is a bottle (not illustrated), the bottle typically includes an upper end portion or other suitable structure on some part of the bottle that defines the bottle mouth portion (i.e., a portion that defines an opening to the bottle interior), and such a mouth portion of a bottle typically has a cross-sectional configuration with which the closure 20 is designed to engage. The main body portion of the bottle may have a cross-sectional configuration that differs from the cross-sectional configuration of the bottle mouth portion. On the other hand, the bottle may instead have a substantially uniform shape along its entire length or height without any portion of reduced size or different cross-section. The bottle may have a generally rigid or flexible wall or walls which can be grasped by the user.

The particular embodiment of the closure 20 illustrated in the FIGS. 1-11B is especially suitable for use with a container (not illustrated) that is either a collapsible, flexible pouch (not illustrated) or a bottle (not illustrated) having a substantially flexible wall or walls that can be squeezed or deflected laterally inwardly by the user to increase the internal pressure within the bottle so as to force the product out of the bottle and through the opened closure. In a bottle with a flexible wall or walls, such a flexible wall or walls typically have sufficient, inherent resiliency so that when the squeezing forces are removed, the bottle walls return to the normal, unstressed shape.

In other applications it may be desirable to employ a generally rigid container, and to pressurize the container interior at selected times with a piston or other pressurizing system to force the product out through the open closure, or to reduce the exterior ambient pressure so as to suck the product out through the open closure.

On the other hand, if the closure 20 has a suitably large access passage that can be opened to communicate with the containment system interior through a large opening in the containment system, then such a closure can be used on a rigid or flexible containment system from which the contents (e.g., the product) can be accessed through the opened closure and removed by pouring out the contents, or by scooping out the contents, or by withdrawing the contents by hand or with an instrument, etc.

In other applications, contents might be added to the containment system through a base or receiving structure 24 of the closure 20 prior to a closing element 28 being installed over the receiving structure.

In still other applications for use with a system which may be a product containment system or other type of system, the closure 20 can function to permit or prevent the egress or ingress of ambient atmosphere, or other substances, relative to the system on which the closure 20 is installed.

In the illustrated embodiment, the closure 20 includes a specially configured closure body or receiving structure 24 and a closing element 28 which is adapted to be installed on, and removed from, the receiving structure 24. As explained hereinafter, the user's initial or partial opening of the closure 20 will permanently alter the physical condition of the closure closing element 28 so as to create or provide a "tamper-evident" indication to subsequent users of the initial opening or partial opening.

The closure body or receiving structure 24 and the closing element 28 are each preferably molded from a suitable thermoplastic material such as polyethylene, polypropylene, or the like. In a presently preferred form of the closure 20, the receiving structure 24 and closing element 28 are preferably each molded separately as a unitary structure from high density polyethylene (HDPE). Other materials may be employed instead.

Figure 3:
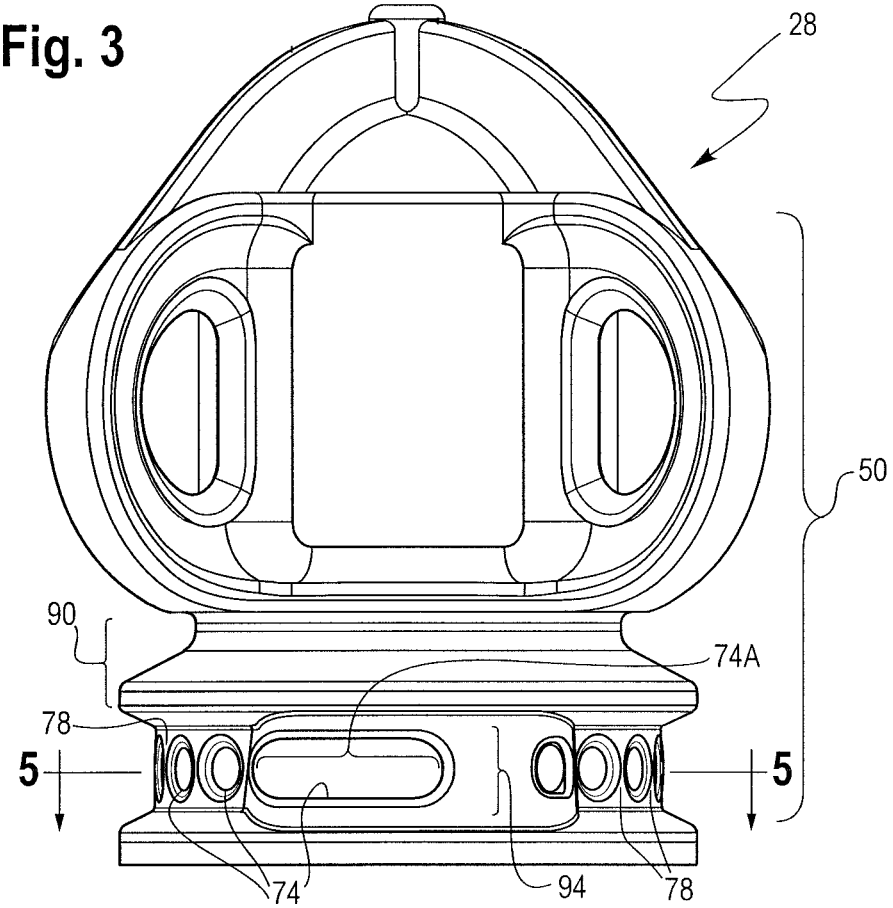
FIG. 3 is a side elevational view of only the closing element shown in FIG. 1 prior to installing the closing element on the receiving structure.
Figure 4:
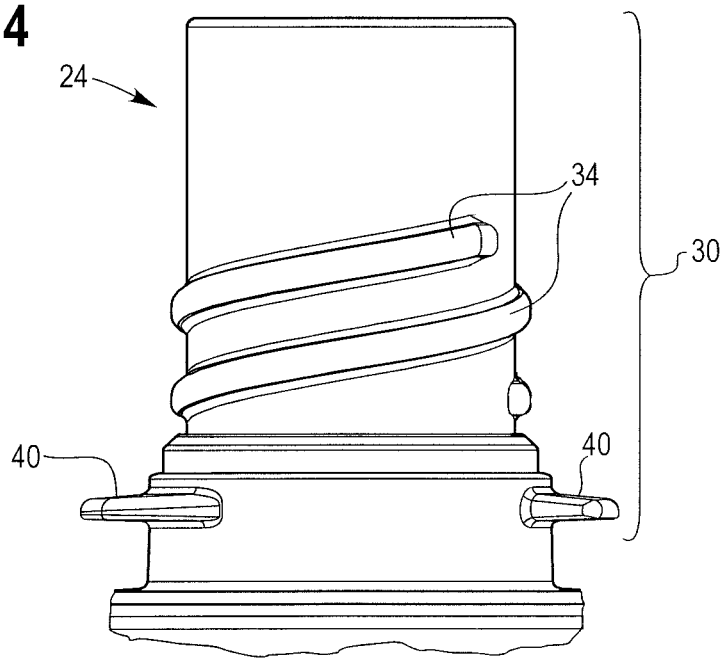
FIG. 4 is a fragmentary, elevational view of the receiving structure shown in FIG. 2.

The closure receiving structure 24 and closing element 28 would typically be separately molded by the manufacturer and assembled together to form the closure 20 for shipment to another location for installation on a system (e.g., a containment system such as a flexible pouch (not illustrated) or a rigid or flexible bottle (not illustrated)). FIG. 3 illustrates the closing element 28 prior to assembly on the receiving structure 24 shown in FIG. 4.

FIG. 1 illustrates the completed closure 20 with the closing element 28 installed in an initially closed condition on the receiving structure 24. FIG. 1 may be characterized as also illustrating the closing element 28 and receiving structure 24 in an initially assembled orientation which prevents, but can be subsequently operated to permit, communication therethrough. Typically, in order to permit communication through the closure 20, the closing element 28 is ultimately removed by the user from the receiving structure 28. In the preferred embodiment illustrated, the closing element 28 is unscrewed from the receiving structure 24 and lifted away so as to afford sufficient access to the receiving structure 24 (the receiving structure 24 being shown in FIG. 2 without the closing element 28).

Figure 2:
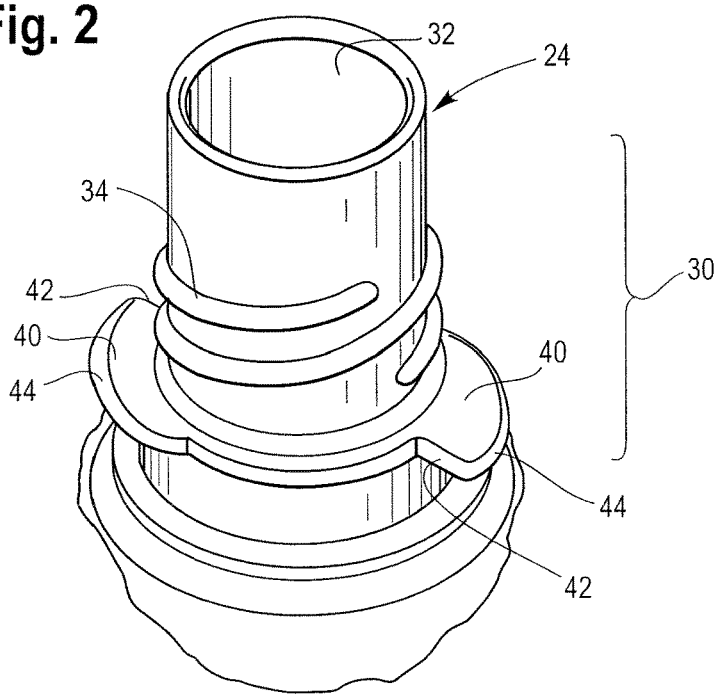
FIG. 2 is a fragmentary, isometric view taken from slightly above the neck of the receiving structure shown in FIG. 1, and in FIG. 2 the receiving structure is shown prior to installation of the closing element on the receiving structure.

With reference to FIG. 2, the receiving structure 24 includes a spout 30 which defines an internal access passage 32 through the receiving structure 24 and which has a distal open end from which a product can be discharged, or into which a substance can be introduced. The term "spout" is used herein in the sense of a tall or a short, upwardly (i.e., axially outwardly) extending boss or other structure defining the access passage 32.

In the illustrated embodiment, the spout 30 also includes one cam 34 or cam follower 34, such as the illustrated helical thread 34. The receiving structure thread 34 could be regarded as either a cam per se or a cam follower per se for engaging a thread 70 on the closing element 28 (FIG. 6) as described hereinafter. That is, if the receiving structure thread 34 is regarded as a cam, then the closing element thread 70 may be regarded as a cam follower. On the other hand, if the receiving structure thread 34 is regarded as the cam follower, then the closing element thread 70 may be regarded as the cam. In either case, it is to be realized that the relative rotational movement between the closing element 28 and the receiving structure 24 could result from rotating the closing element 28 relative to the receiving structure 24 being held stationary, or could result from rotating the receiving structure 24 (along with the attached system) relative to the closing element 28 being held stationary, or could result from rotating both the closing element 28 and receiving structure 24 simultaneously in opposite directions. In the illustrated preferred embodiment, the thread 34 and the thread 70 are each a dual lead helical thread having an identical predetermined pitch.

The receiving structure 24 also includes at last one laterally projecting shear member 40. In the preferred embodiment illustrated in FIG. 2, there are two such laterally projecting shear members 40 located below the thread 34. The shear members 40 may be located on, or as part of, the spout 30, or may be located below the spout 30. In alternate forms (not illustrated), each shear member (40) could be joined to the spout (30) with one or more vertical and horizontal legs so as to locate the shear member (40) at a particular elevation alongside the spout (30) above, below, or adjacent the spout thread (34).

Opposite the distal open end of the receiving structure access passage 32, the receiving structure 24 may include a suitable structure for being mounted to a system, such as a containment system that may be a collapsible, flexible pouch (not illustrated) or a bottle (not illustrated), or other containment system, or other structure of a system to which the closure 20 is intended to be attached. For use with a collapsible, flexible pouch, the bottom portion of the closure receiving structure 24 may include a suitable conventional or special fitment (e.g., a "boat-shaped," heat-sealable fitment (not shown) such as disclosed in the U.S. Pat. No. RE 39,520, the details of which form no part of the broad aspects of the present invention).

If the containment system is a pouch, then it is presently contemplated that most pouch manufacturers will prefer to have the closure 20 provided to them with a suitable fitment at the lower end, and then install the closure 20 on the pouch with heat sealing techniques.

If the containment system is a bottle, then it is presently contemplated that most bottlers would prefer to have the closure 20 provided to them with the closure receiving structure 24 not only including the thread 34 (i.e., cam 34 or cam follower 34), but also with the bottom of the closure receiving structure 24 suitably configured with a snap-fit attachment feature or threaded attachment feature (the details of which form no part of the present invention) for installation of the closure 20 on the bottle which would mate with the attachment configuration on the bottom of the closure receiving structure 24.

The closed closure 20 would typically be shipped to a pouch manufacturer or bottler which would provide a containment system (e.g., a pouch or bottle, not illustrated), and the pouch manufacturer or bottler would install the closure 20 on the pouch or bottle. The particular containment system (e.g., pouch or bottle) may have already been filled with product. Alternatively, the closure 20 may be installed on an empty containment system which is subsequently filled with product through an open bottom end of the containment system which is thereafter sealed closed.

The bottom of the closure receiving structure 24 can readily be provided with various attachment configuration features (not shown) suitable for a particular application-especially for a pouch or a bottle having semi-rigid, resilient walls, or having rigid walls. For example, the closure receiving structure 24 can be provided with suitable snap-fit engagement beads (not illustrated) for engaging complementary or mating features on the bottle (not illustrated) or other system. Such an engagement would resist removal of the closure 20 by a user of the package. In an alternate arrangement (not illustrated), the closure receiving structure 24 could have a lower, round end with a thread for threadingly engaging a mating thread of a bottle (not illustrated) or other system.

Further, other means of providing a generally non-removable or removable attachment of the closure 20 to the container (not illustrated) or other system are contemplated. These other means could include the use of a suitable mechanical lock, spin welding of the closure to the system, mechanical staking, adhesive, etc.

Figure 6:
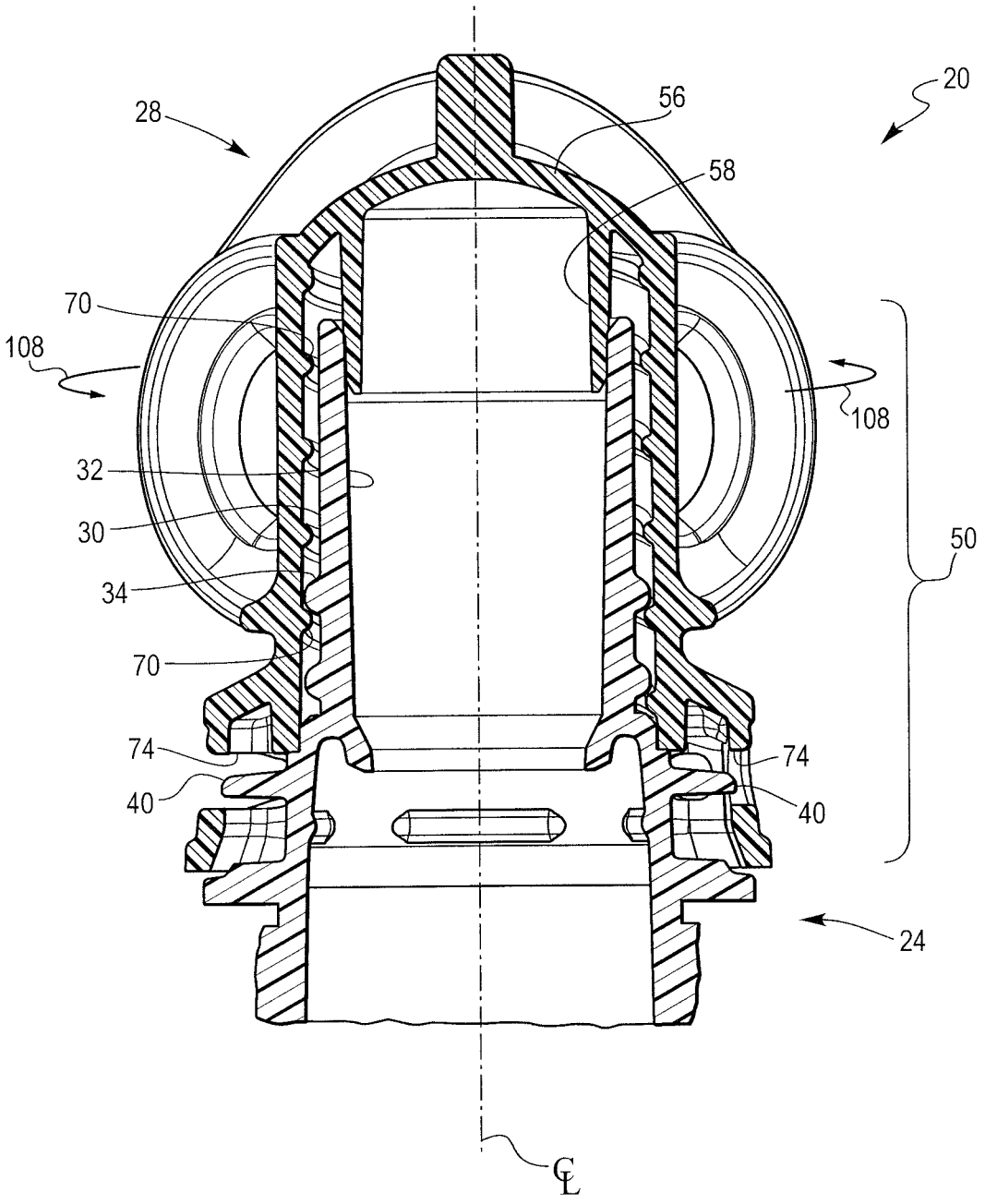
FIG. 6 is a fragmentary, cross-sectional view taken generally along the plane 6-6 in FIG. 1.

The access passage 32 in the spout 30 of the receiving structure 24 can be seen in FIG. 6. The access passage 32 extends from the distal, outer end of the spout 30 and through the rest of the receiving structure 24. The access passage 32 communicates with an opening of the pouch or bottle (not illustrated) or other system, and the passage 32 permits material (gases, fluids, solids, etc.) to pass between the exterior and the interior of the system.

It is to be understood that the access passage 32 need not be circular as shown. The access passage 32 may be elliptical, polygonal, or some other regular or irregular shape.

Figure 7:
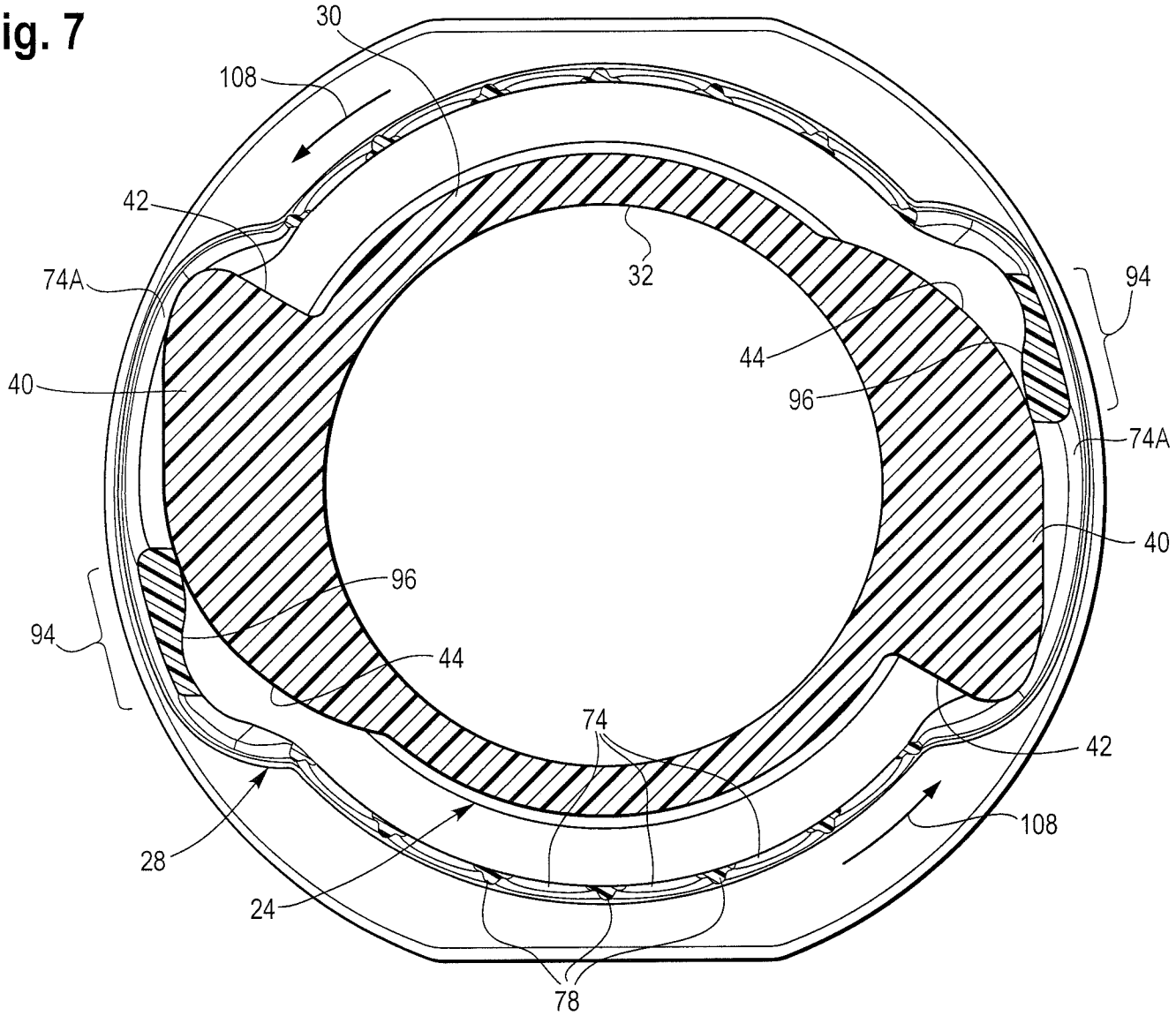
FIG. 7 is a cross-sectional view taken generally along the plane 7-7 in FIG. 6.

As can be seen in FIGS. 2 and 7, each shear member 40 has a leading edge 42 and a trailing edge 44. Each shear member 40 may alternatively be described as a shear fin. Preferably, each shear fin or shear member 40 is relatively smooth to accommodate intentional or accidental contact of the shear member 40 by a user's finger and/or lip.

The closing element 28 is adapted to be installed on the receiving structure 24 in an initially assembled orientation defining an initially fully closed condition. In this condition, a combination of the closing element 28 and receiving structure 24 together define an initially assembled orientation which prevents, but can be subsequently operated to permit, communication through the receiving structure. The operation to permit communication through the receiving structure 24 is the unscrewing of the closing element 28 from the receiving structure 24 as described hereinafter.

In the illustrated preferred embodiment, the closing element 28 has a skirt 50 for engaging at least a portion of the receiving structure spout 30 as can be seen in FIG. 6. Further, as can be seen in FIG. 6, the upper end of the closing element skirt 50 is closed by an end portion 56. As can be seen in FIG. 6, the skirt 50 is defined by a generally cylindrical sleeve having a larger diameter lower end portion.

In an alternate (but not illustrated) form of the skirt 50, the skirt 50 could include two generally cylindrical concentric sleeves joined together at their upper ends, for example, at or near the closing element top end portion 56.

As can be seen in FIG. 6, depending downwardly from the inside of the closing element top end portion 56 is an internal plug seal 58 which is generally cylindrical (in the illustrated preferred embodiment), but which is preferably slightly tapered (at least on the exterior) so as to sealingly engage an internal edge portion of the receiving structure spout 30 on the inside of the distal open end of the spout 30.

Preferably, as can be seen in FIG. 1, the closing element 28 also preferably includes tabs 62 on the outside of the closing element 28, and the tabs 62 are adapted to be engaged by a user's fingers and thumb to assist in rotating the closing element 28 relative to the receiving structure 24. In the preferred embodiment illustrated, each tab 62 defines an aperture 64 which minimizes the amount of material required for forming each tab 62 and which may provide an additional gripping feature to permit the user's fingers and/or thumb to better engage one or more of the tabs 62.

With reference to FIGS. 3 and 6, the bottom of the closing element 28 defines an open end (not numbered) into which the receiving structure spout 30 extends to accommodate relative rotation between the closing element 28 and the receiving structure 24.

An inside portion of the closing element skirt 50 defines the cam 70 or a cam follower 70, which in the illustrated preferred embodiment, is the previously identified helical thread 70 for engaging the helical thread 34 on the receiving structure spout 30. The thread 70 could be regarded either as a cam per se or a cam follower per se for engaging the receiving structure thread 34. That is, if closing element thread 70 is regarded as the cam, then the receiving structure thread 34 would be regarded as the cam follower. On the other hand, if the closing element thread 70 is regarded as the cam follower, then the receiving structure thread 34 would be regarded as the cam. In either case, it is to be realized that the relative rotational movement between the closing element 28 and the receiving structure 24 could result from rotating the closing element 28 relative to the receiving structure 24 being held stationary, or could result from rotating the receiving structure 24 (and attached system (e.g., a bottle)) relative to the closing element 28 being held stationary, or could result from rotating both the closing element 28 and receiving structure 24 (and attached system) simultaneously in opposite directions.

Figure 6A:
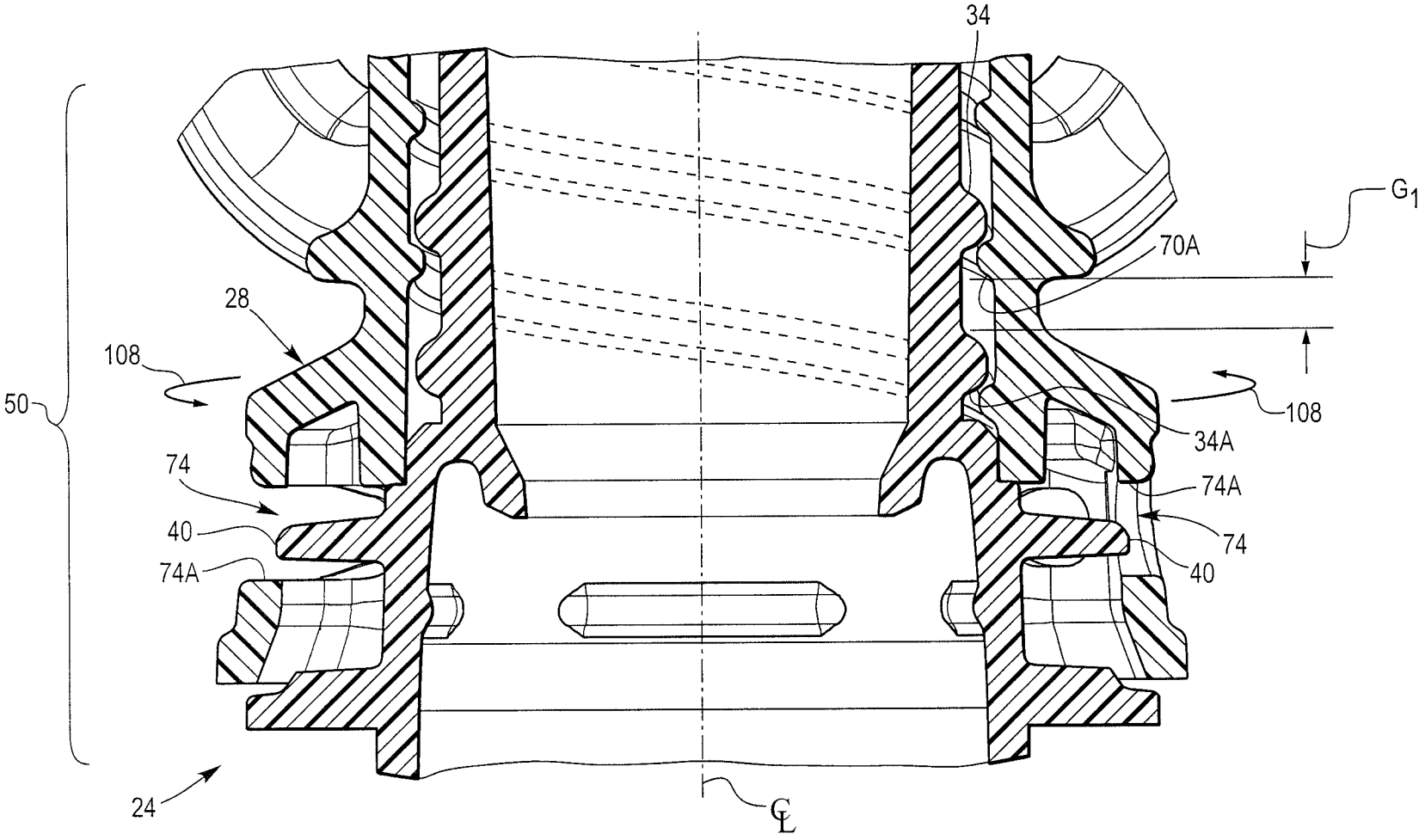
FIG. 6A is a generally enlarged, fragmentary portion of the cross-sectional view shown in FIG. 6.

In the illustrated preferred embodiment, each thread 34 and 70 is a dual lead helical thread having a predetermined pitch. The pitch is selected to provide an initial gap $G_1$ (FIG. 6A) between the threads 34 and 70 when the closing element 28 and receiving structure 24 are in the initially assembled orientation (FIGS. 6 and 6A).

In the preferred embodiment illustrated, the closing element thread 70 is defined in an upper portion of the skirt 50. Between the thread 70 and the open bottom end of the skirt 50, a lower, larger diameter, portion of the skirt 50 defines two apertures 74 (FIG. 3) each extending in an arc around part of the skirt 50, and the two apertures 74 are each divided into smaller holes or openings by one or more frangible bridges 78.

In the preferred embodiment illustrated in FIG. 3, a plurality of frangible bridges 78 extend across each aperture 74 to divide each aperture 74 into a plurality of smaller holes or openings that are each separated from an adjacent smaller hole or opening by one of seven frangible bridges 74. With reference to FIG. 3, there are seven of the smaller openings which are small circular holes, but each aperture 74 also has another portion, which is designated 74A in FIG. 3, that is larger than each of the seven circular holes and that has a generally elongate shape or oval shape.

In the preferred embodiment illustrated, the skirt lower portion of the closing element 28 defines two such elongate apertures 74A located 180° apart. Each such elongate aperture 74A is associated with the seven smaller circular holes which, together with the elongated opening 74A, comprise the one large aperture 74 divided by the seven frangible bridges 78.

Each bridge 78 that is defined between two of the smaller adjacent holes has concave sides which define a bridge structure with a narrow middle portion between wider top and bottom end portions. This shape minimizes the effect of flow path restriction during molding and accommodates a better filling pattern of the molten plastic resin flow during molding so as to provide a better mold fill with a reduced likelihood of creating voids or cavities. This provides a wider processing window with respect to the injection molding machine.

The shape of the frangible bridge 78 is easier to mold, and provides a greater strength even though the bridge is relatively thin at the narrowest point. This allows the designer to maximize the vertical height of the bridge. Thus, the tapering shape leading to the narrow part of the bridge accommodates a thicker, stronger shear member 40 in an adjacent portion of the aperture 75 when the closing element 28 is rotated relative to the receiving structure 24 as is described in detail hereinafter.

There may be fewer than seven circular holes defining part of the aperture 74, or there may be more than seven such circular holes. That is, the number of frangible bridges 78 extending across the aperture 74 to define the smaller holes may be fewer than seven or may be more than seven. As viewed in FIG. 1, most of the frangible bridges 78 have oppositely facing sides that each has a concave configuration that defines the above-described tapering shape which provides the above-described advantages. The shapes of the smaller holes, the oval portion 74A, and the bridges 78 may be different than illustrated and may be varied.

Figure 5:
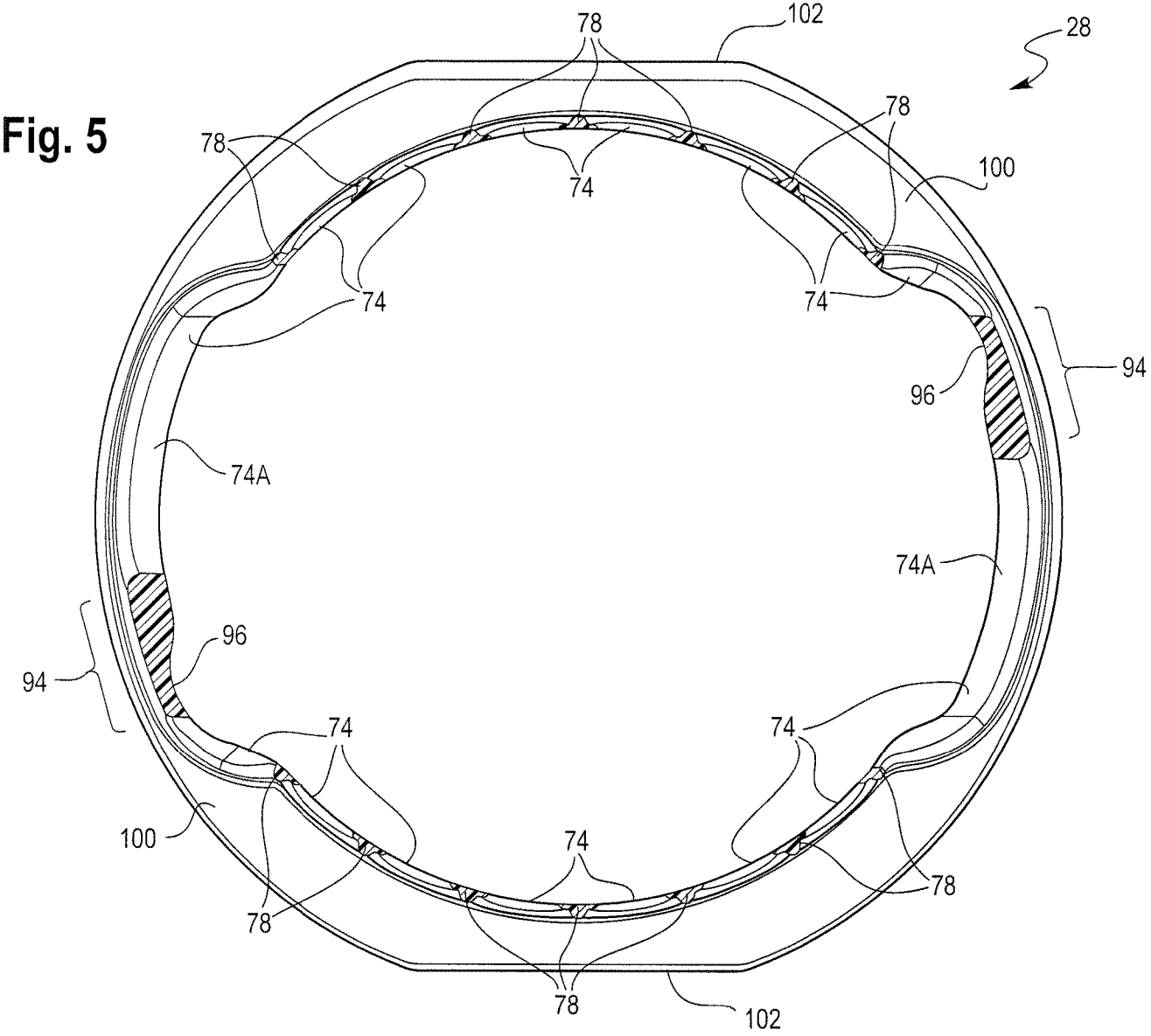
FIG. 5 is a greatly enlarged cross-sectional view taken generally along the plane 5-5 in FIG. 3.

As can be seen in FIGS. 3, 5, and 6, the upper portion of the closing element skirt 50 that defines the cam or cam follower helical thread 70 is joined by at least one non-frangible, but deformable, tether web 94 to the lower portion of the skirt 50 that defines the two divided apertures 74. As can be seen in FIGS. 3 and 5, the tether web 94 defines an internal recess 96. In the preferred embodiment, there are two such tether webs 94 (each with a recess 96) located about 180° apart. Each recess 96 is radially inwardly open, and each recess 96 extends axially so that is axially open at the bottom open end of the skirt 50.

In the preferred embodiment illustrated, the closure receiving structure 24 has two oppositely facing, 180° spaced-apart shear members 40, and the closing element skirt 50 has two sets of multiple-bridged apertures 74 divided by the frangible bridges 78 into smaller openings, and each of the two sets of apertures 74 and frangible bridges 78 is designed to interact with an associated one of the two shear members 40 as explained hereinafter.

Figure 8:
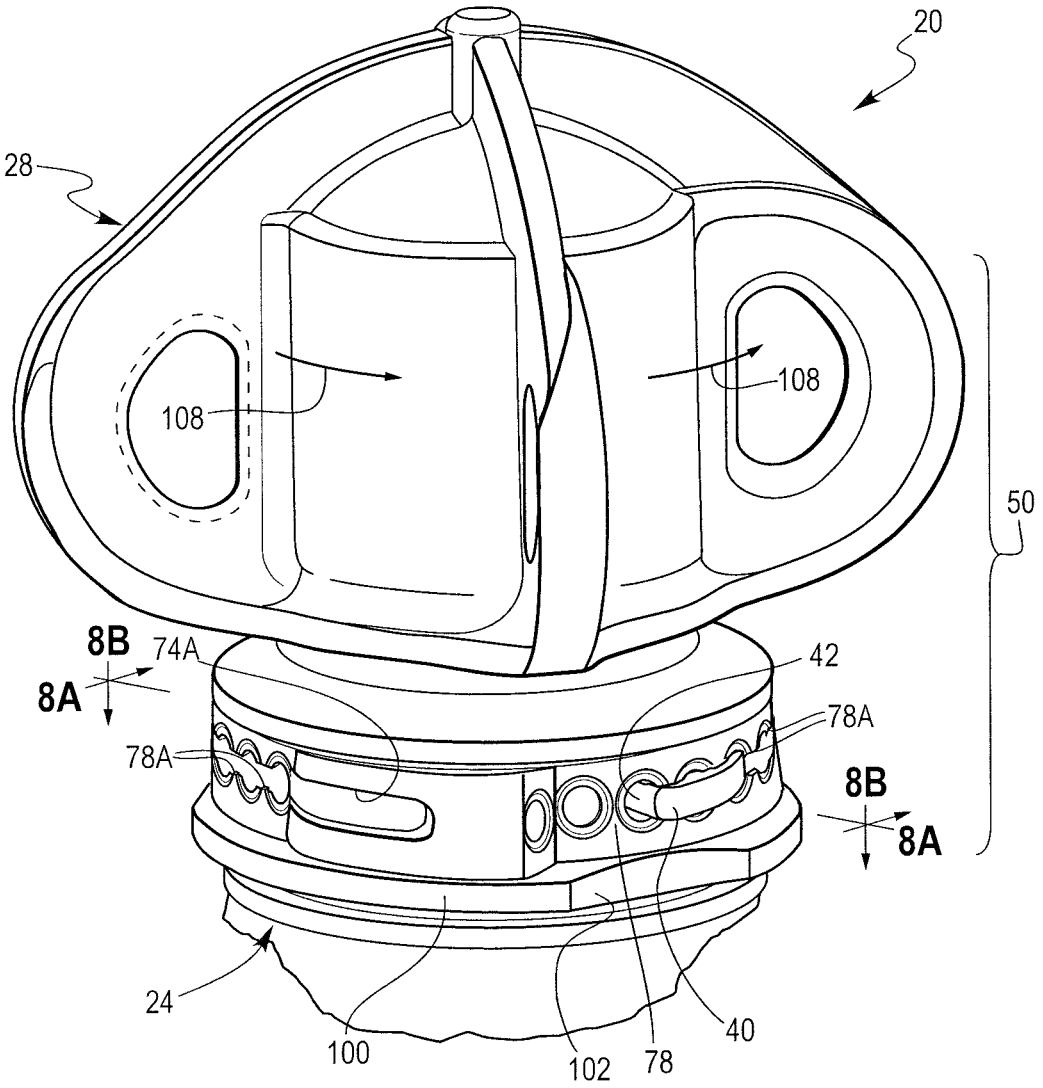
FIG. 8 is an isometric view of the closure with the closing element rotated in the opening direction away from the initially assembled orientation and partway towards the fully opened condition.

As can be seen in FIGS. 5 and 8, the lower edge of the skirt 50 has a generally circular flange 100 having two oppositely facing planar surfaces 102 which are 180° apart. These may be used as keys or guides to establish a desired orientation during conveyance and assembly of closing element 28 with the receiving structure 24.

Initially, the closure receiving structure 24 and the closure closing element 28 are preferably separately molded or otherwise provided as separate components. Subsequently, in a preferred process, the manufacturer assembles the two components together by effecting relative axial movement between the two components so as to force the spout 30 of the receiving structure 24 into the skirt 50 of the closing element 28. At least a portion of at least one of the components (typically the skirt 50 of the closing element 28), is sufficiently flexible and resilient to accommodate the insertion of the receiving structure spout 30 into the open end of the closing element skirt 50 in the initially assembled orientation (FIGS. 1, 6, and 7). In the initially assembled orientation, each shear member 40 is located so that it is received in the elongate opening portion 74A of one of the apertures 74. The assembly process is preferably effected without relative rotation between the closing element 28 and receiving structure 24. However, in an alternate assembly process, the two components could be threaded together and screwed into the initially assembled orientation.

After the assembly of the receiving structure 24 and closing element 28 in the initially assembled orientation (which is the initial, fully closed condition), the receiving structure spout thread 34 does not engage the closing element skirt thread 70 in a manner that would effect axial movement of the closing element 28 during an initial amount of relative rotation between the receiving structure 24 and closing element 28. Rather, the receiving structure thread 34 and closing element thread 70 have a predetermined, identical pitch and are initially separated by a predetermined gap $G_1$ (FIG. 6A) so that initial rotation of the closing element 28 in the opening direction (indicated by arrow 108 in FIG. 6A) relative to the receiving structure 24 will not initially cause an upward, axial movement of the closing element 28 owing to the gap $G_1$. The manner in which the parts interact during the initial rotation can be more specifically explained with reference to FIGS. 6A, 8A, 9A, and 11A wherein the lowermost portion of the closing element thread 70 is shown in cross section on the right hand side in each Figure and is designated 70A, and the lowermost portion of the receiving element thread 34 is shown in cross section on the right hand side of each Figure and is designated 34A. With particular reference to FIG. 6A, the portion of the thread 70 designated as 70A in FIG. 6 will be rotated behind the plane of the view in FIG. 6A and will not engage the upwardly facing camming surface of the receiving structure thread portion 34A until the closing element 28 has been rotated about 100° from the position illustrated in FIG. 6A. Thus, the first approximately 100° of rotation of the closing element 28 relative to the receiving structure 24 does not immediately cause engagement of the closing element thread 70 with the receiving structure thread 34 in a way that would cause axial translation (i.e., axial movement) of the closing element 28.

Figure 8A:
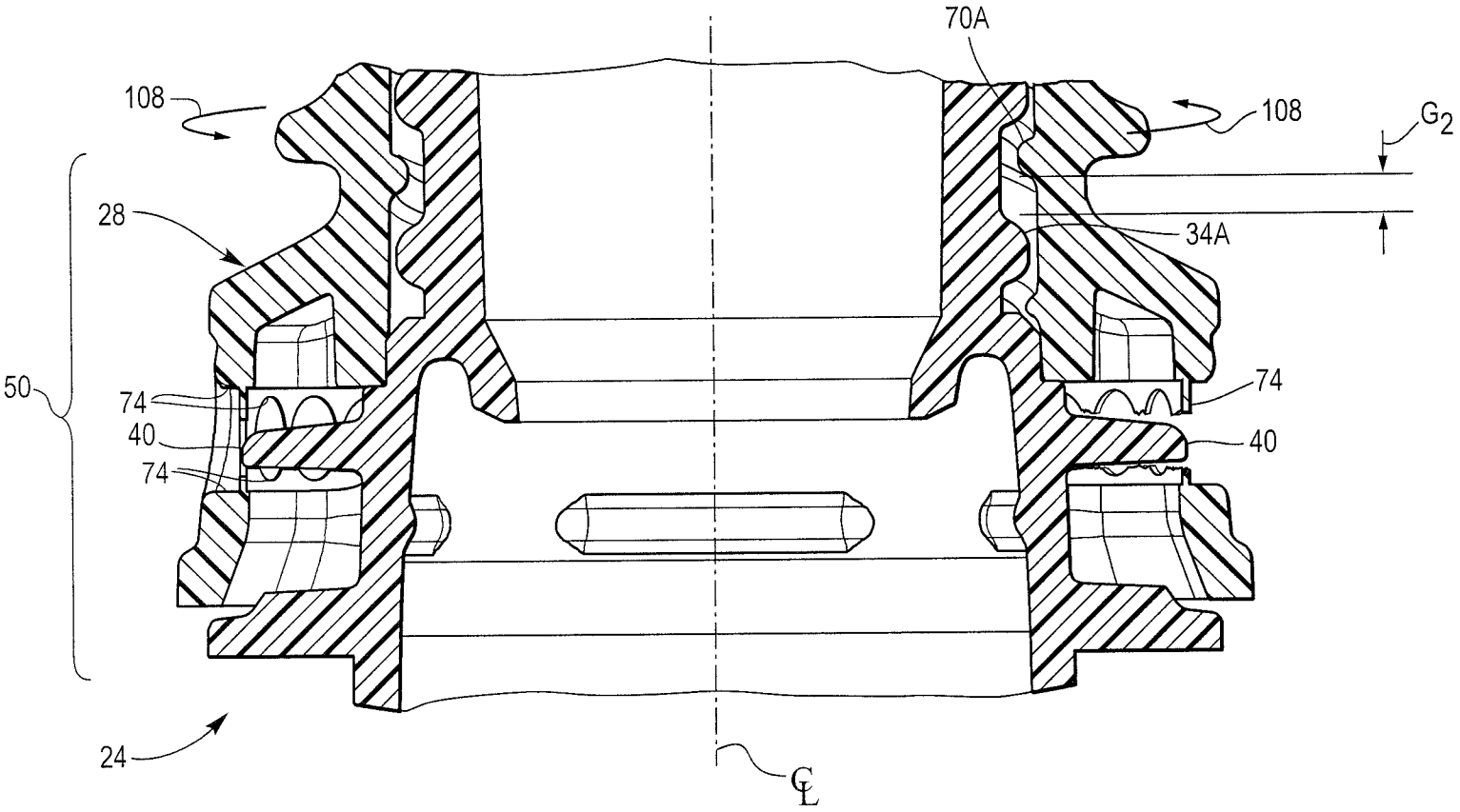
FIG. 8A is a fragmentary, cross-sectional view taken generally along the plane 8A-8A in FIG. 8.
Figure 8B:
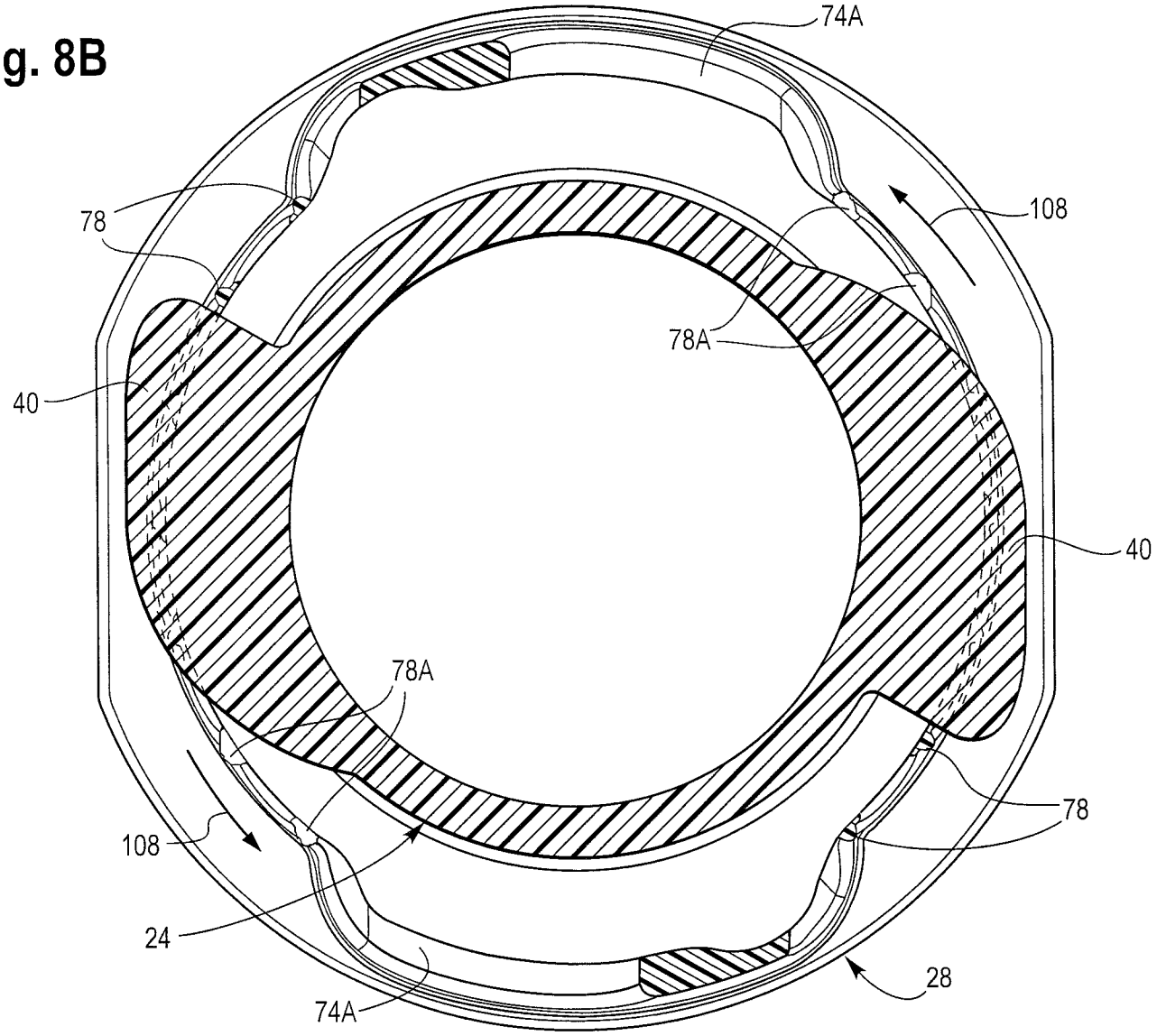
FIG. 8B is a cross-sectional view taken generally along the plane 8B-8B in FIG. 8.
Figure 9:
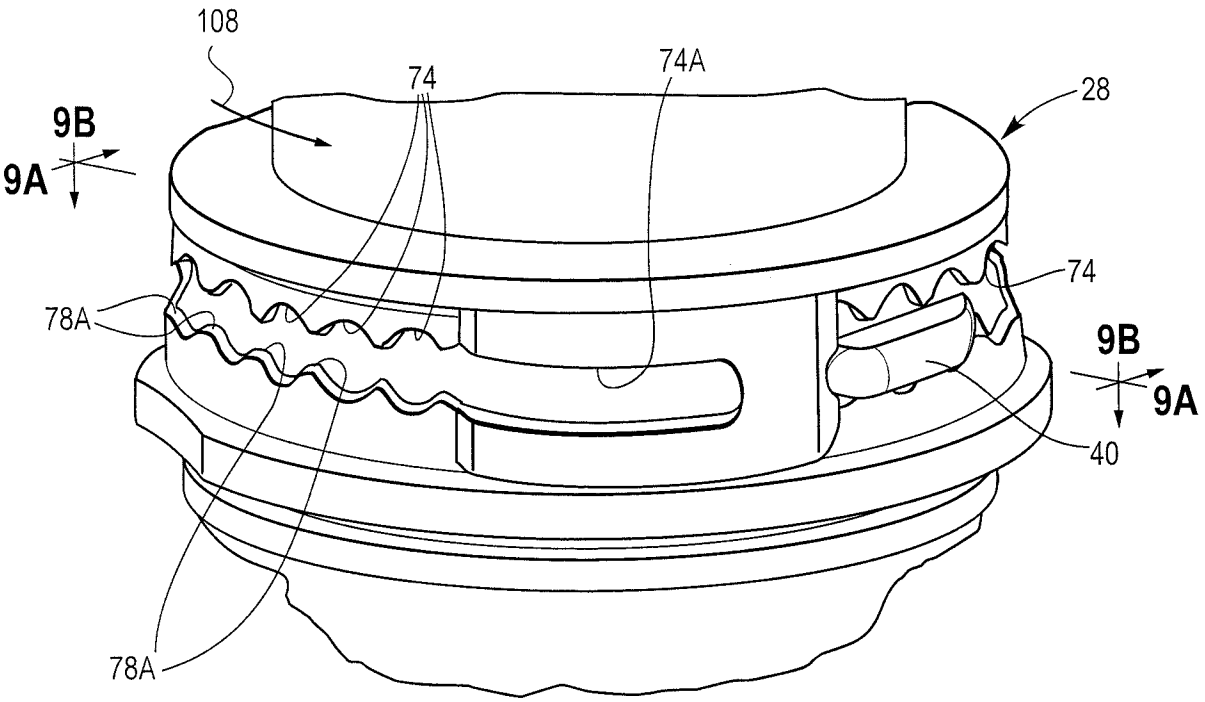
FIG. 9 is a fragmentary, isometric view similar to FIG. 8, but in FIG. 9 the closing element has been rotated further in the opening direction away from the initially assembled orientation.
Figure 9A:
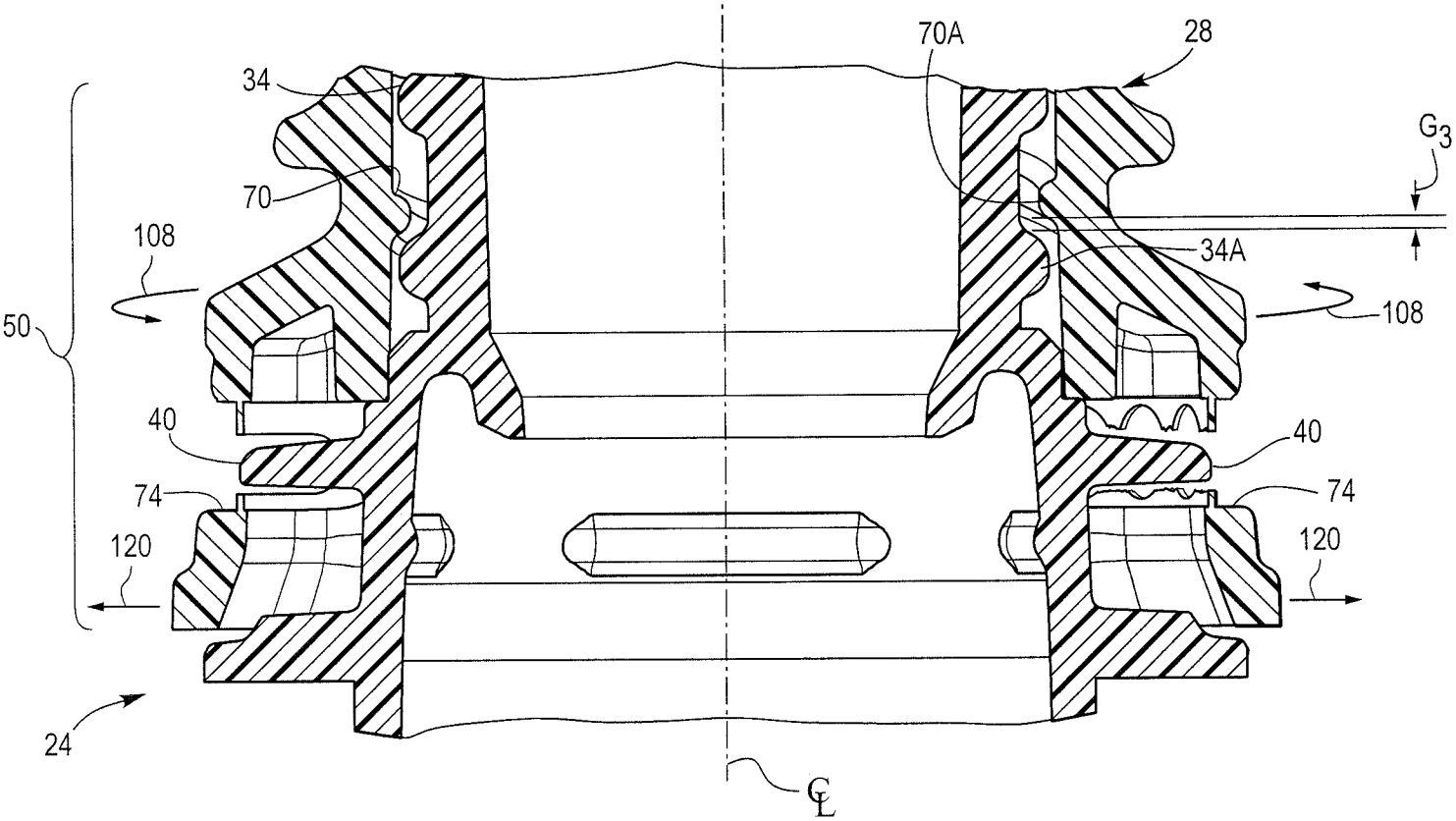
FIG. 9A is a fragmentary, cross-sectional view taken generally along the plane 9A-9A in FIG. 9.

Continued rotation of the closing element 28 away from the initially assembled orientation shown in FIGS. 1 and 6A will cause the gap between the closing element thread 34/34A and the receiving structure thread 70/70A to decrease to a smaller gap $G_2$ as can be seen in FIG. 8A for the cross-sectional portion of the threads designated as 34A and 70A in FIG. 8A. Further rotation of the closing element 28 reduces the gap further, as can be seen in FIG. 9A where the reduced gap is indicated by $G_3$. After about 100° of rotation of the closing element 28 relative to the receiving structure 24 as shown in FIG. 10A, it can be seen that the cross-sectional portion of the closing element thread 70A has contacted the cross-sectional portion of the receiving structure thread 34A, and the gap has gone to zero as indicated at $G_4$. The arrangement of the threads 34 and 70 with an initial gap $G_1$ between the threads can be designed in a conventional manner by one of ordinary skill in the art.

In view of the initial thread gap arrangement, if a user attempts to open the closing element 28 by rotating the closing element 28 in the counterclockwise direction as indicated by the arrows 108 in FIG. 7, then the closing element 28 will initially rotate about the vertical axis, but will not initially move axially outwardly up and along the receiving structure spout 30. The receiving structure thread 34 and closing element thread 70 are configured with the initial gap $G_1$ so that they do not effect axial relative movement between the receiving structure 24 and closing element 28 until relative rotation has occurred over a predetermined angle of rotation (e.g., about 100°). Only after a sufficient amount of initial relative rotation do the threads 34 and 70 cooperate to cause the closing element 28 to move axially upwardly (outwardly) along the closure receiving structure spout 30.

The amount of rotation required before the closing element 28 is axially moved relative to the receiving structure 24 may be greater or smaller than 100°, depending on the particular designs of the skirt apertures 74 and various other features of the closure 20.

In the initially assembled orientation illustrated in FIGS. 1, 6, and 7, each shear member 40 projects outwardly into, and preferably partially through, one of the associated closing element skirt apertures 74—and in particular, partially through the elongate portion 74A of the aperture 74 which is initially divided by the plurality of frangible bridges 78. As the relative rotation is effected between the closing element 28 and the receiving structure 24, typically by a user grasping and rotating the closing element 28 in the counterclockwise direction indicated by the arrows 108 (FIGS. 7 and 8), the frangible bridges 78 sequentially move against the leading edge 42 of the associated shear member 40 and are severed by the shear member 40. FIG. 8 illustrates the relative positions of the receiving structure 24 and closing element 28 after some amount of initial relative rotation between the two components, and in FIG. 8 it can be see that the shear members 40 have severed a number of the frangible bridges (the severed ends of which are designated 78A in FIG. 8).

Figure 9B:
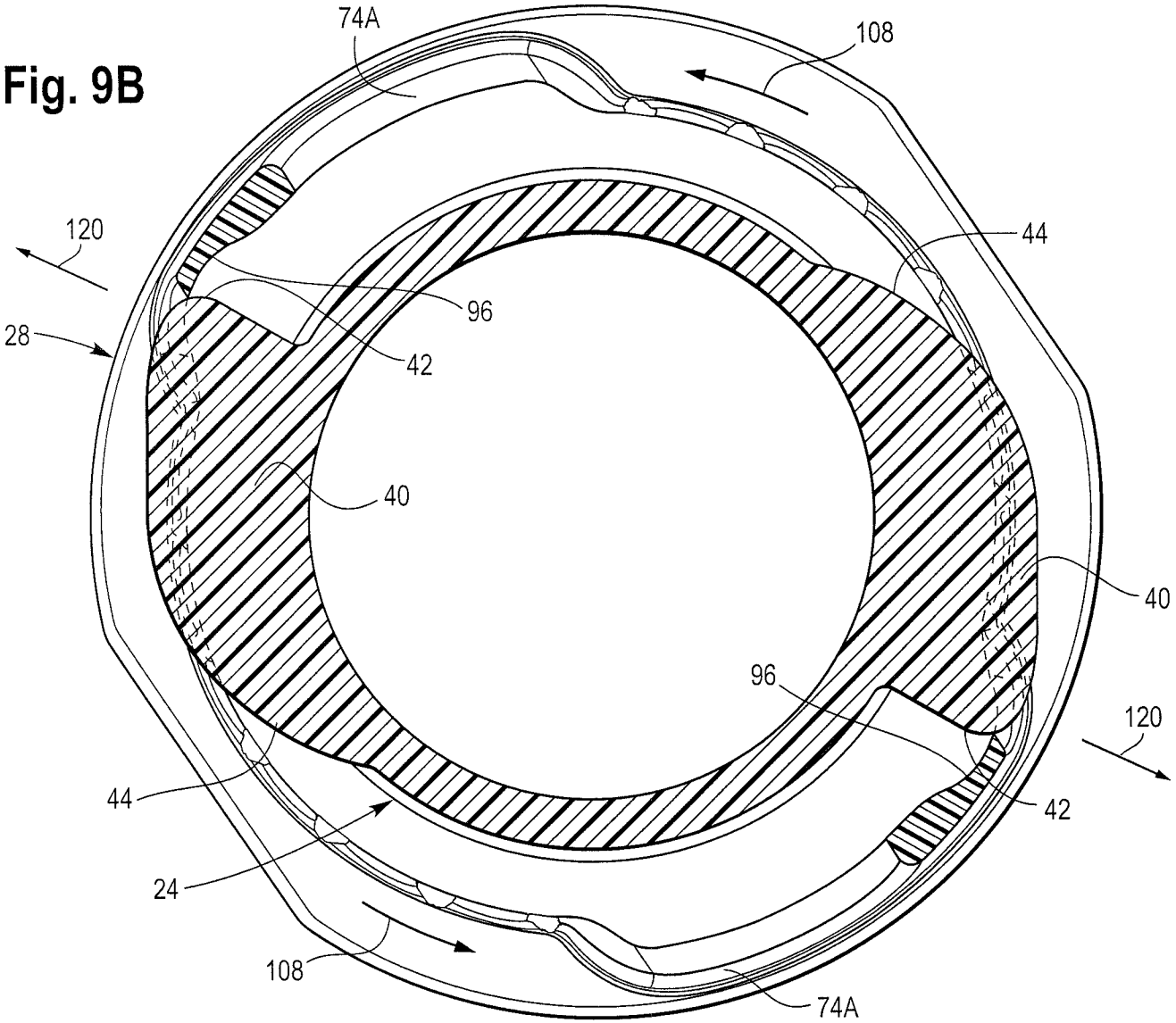
FIG. 9B is a cross-sectional view taken generally along the plane 9B-9B in FIG. 9.

As the user continues to rotate the closing element 28 in the counterclockwise direction as indicated by the arrows 108 in FIG. 8, the closing element thread 70 and the receiving structure thread 34 are not yet effective to cause axial movement of the closing element 28 until a predetermined amount of rotation has occurred (e.g., about 100°) as previously explained—thus the closing element 28 initially only rotates, but does not initially move axially upwardly relative to the receiving structure 24. The user continues rotating the closing element 28 so that the projecting shear members 40 each sequentially sever the associated frangible bridges 78. After the last frangible bridge 78 has been severed as illustrated in FIGS. 9, 9A, and 9B, the leading end 42 of each laterally projecting shear member 40 begins to engage the part of the tether web 94 between the last sheared frangible bridge 78/78A and the beginning of the elongate opening portion 74A of the other aperture 74. This engagement of the skirt tether webs 94 with the shear members 40 can cause the lower portion of the skirt 50 to deform radially outwardly (at least temporarily) in opposite directions as indicated by the arrows 120 in FIGS. 9A and 9B. This causes a radial distortion (which may be temporary or permanent) in the closing element lower portion of the skirt 50 (especially at the tether webs 94), and this radial distortion is readily apparent to the user as the user continues to rotate the closing element 28 in the opening direction (indicated by the rotational arrows 108 in FIGS. 9, 9A, and 9B).

In some applications, it may be desired that the radial distortion and deformation of the lower portion of the skirt 50 be only elastic and temporary. In other applications, it may be desired to provide a design in which at least some amount of the radial distortion and deformation of the closing element 28 is a permanent, inelastic deformation. While the permanent radial deformation and distortion of the lower part of the skirt 50 of the closing element 28 might be desirable in some embodiments of the invention, and while such permanent distortion could provide evidence of the opening of, or at last an attempt to open, the closure 20, it is not a necessary requirement or essential feature of the broad aspects of the present invention that the radial deformation be permanent (or that it be temporary).

During the opening process, as the closing element 28 is rotated (in the opening direction indicated by the arrows 108) and as the frangible bridges 78 are severed by the shear members 40, the severing of each frangible bridge 78 preferably generates an audible click. As the frangible bridges 78 are sequentially severed, the audible clicks may sound somewhat like the noise created when a conventional zipper is opened or closed. The user can tell from the sound that the frangible bridges 78 are being severed. Of course, the user can also visually observe the severing of the frangible bridges 78. Depending on the material from which the closing element 28 is molded, and depending on the particular thickness and/or shape of each frangible bridge 78, the sound generated by the severing of each frangible bridge 78 may be more or less audible to the user. According to the broad aspects of the present invention, although the generation of a sound that is particularly audible to the user is preferred, that is not a necessary requirement or essential feature of the broad aspects of the invention.

As the frangible bridges 78 are severed, whether or not a sound is heard by the user, the severing of each frangible bridge 78 may also provide a slight tactile feedback so that a relatively rapid rotation of the closing element 28 through a first angle of rotation (e.g., 100°) can result in a generally continuous vibratory feeling or feedback that is sensed by the user who is opening the closure. According to the broad aspects of the invention, such discernible tactile feedback, while preferred, is not a required or essential feature of the broad aspects of the invention.

Figure 10:
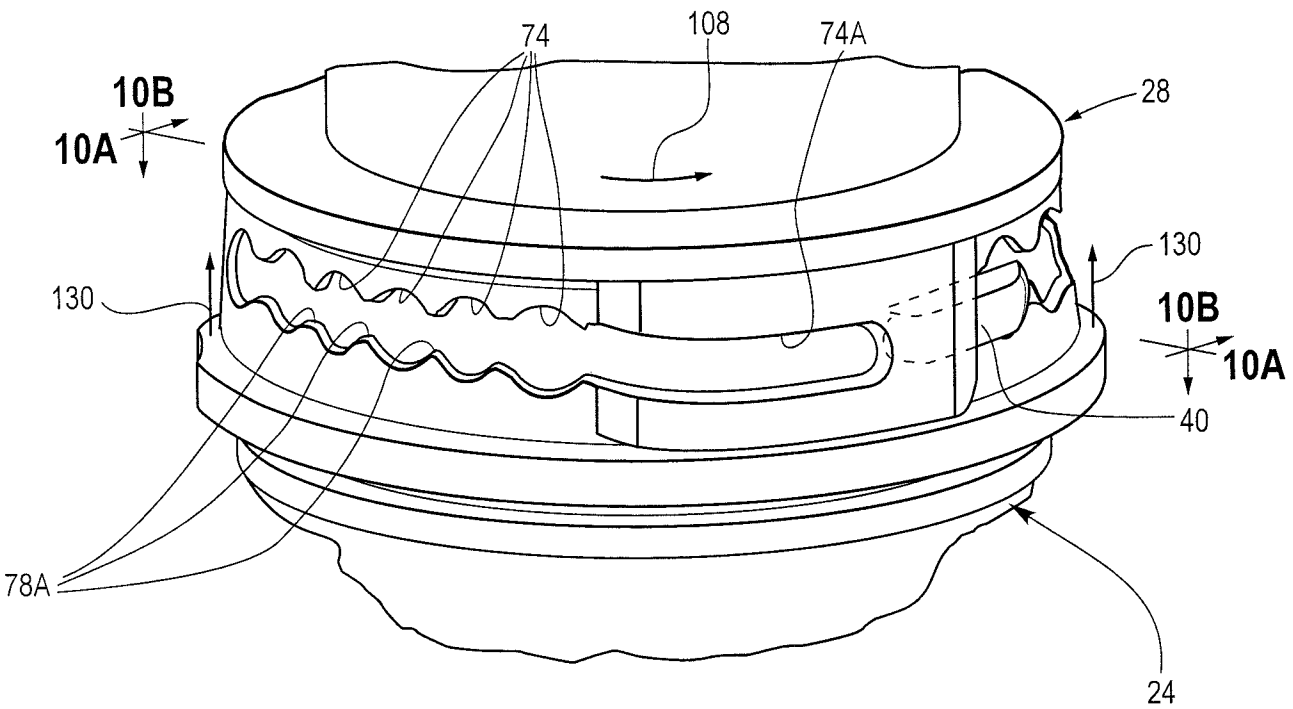
FIG. 10 is a fragmentary, isometric view similar to FIG. 9, but in FIG. 10, the closing element has been rotated even further in the opening direction away from the initially assembled orientation.
Figure 10A:
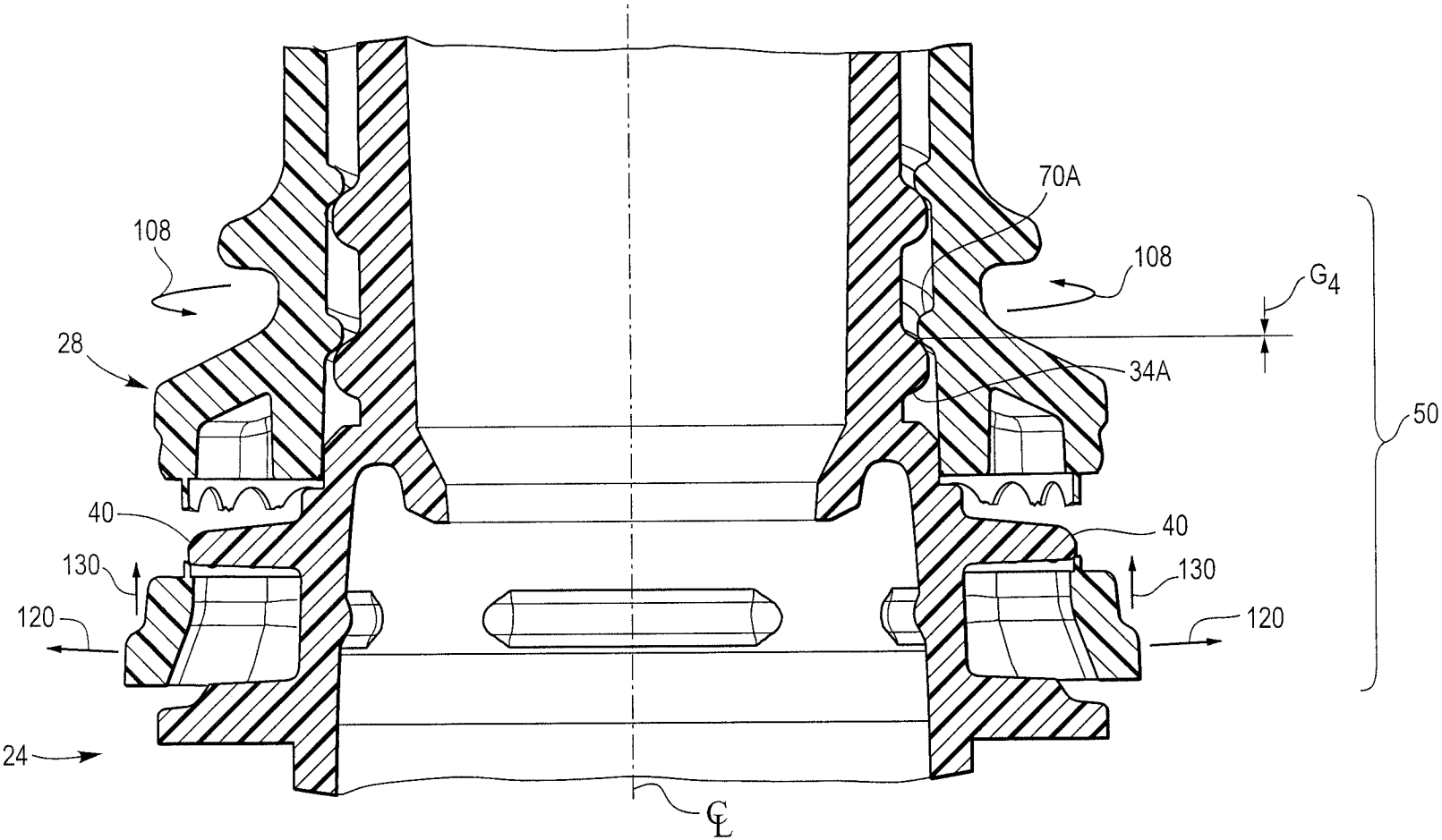
FIG. 10A is a fragmentary, cross-sectional view taken generally along the plane 10A-10A in FIG. 10.
Figure 10B:
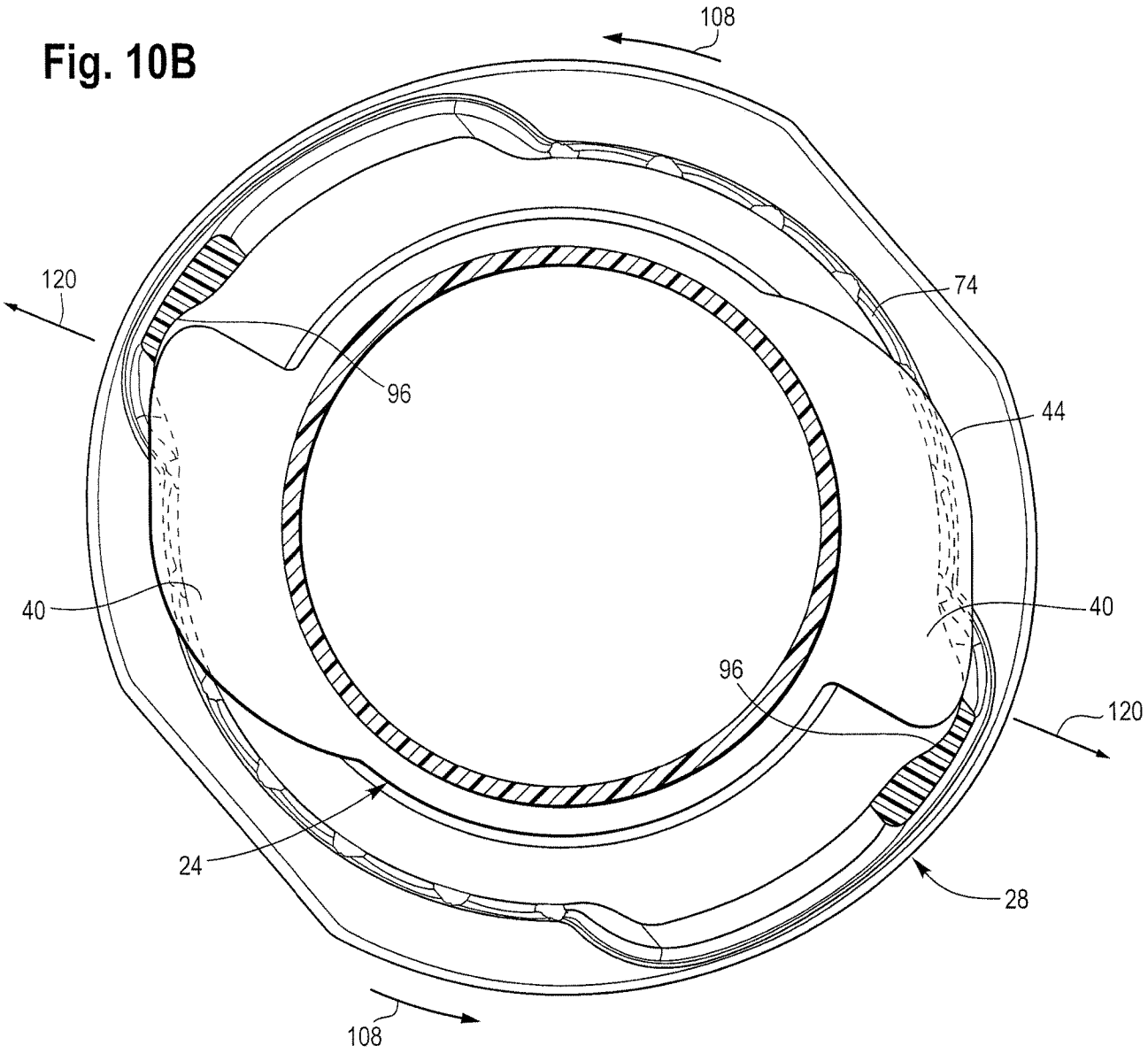
FIG. 10B is a cross-sectional view taken generally along the plane 10B-10B in FIG. 10.

As each shear member 40 begins to engage, and outwardly deform, the lower portion of the skirt 50 of the closing element 28, the receiving structure thread 34 and the closing element thread 70 begin to contact in a camming engagement that exerts an axial force on the closing element 28 tending to urge the closing element 28 axially upwardly relative to the receiving structure 24—toward the position shown in FIGS. 10, 10A, and 10B. However, the closing element 28 is not initially free to move upwardly relative to the receiving structure 24, because, as can be seen in FIGS. 9, 9A, and 9B, a portion of each shear member 40 still lies within the associated aperture 74—thereby preventing upward movement of the portion of the skirt 50 below the apertures 74. Thus, the closing element skirt 50 becomes subject to axial tension and begins to elongate very slightly—preferably within the elastic range of the material.

Continued rotation of the closing element 28 from the position shown in FIGS. 9, 9A, and 9B tends to urge the closing element 28 axially toward the position shown in FIGS. 10, 10A, and 10B while causing the closing element recesses 96 (FIGS. 9B and 10B) to be moved adjacent the shear members 40, and each recess 96 in the deformed tether web 94 accommodates the largest radial dimension of each shear member 40. As can be seen in FIGS. 9B and 10B, each shear member 40 is laterally tapered so that it narrows toward its trailing end 44. The decreasing radial extent of each shear member 40 toward its trailing end 44 is such that, after sufficient rotation of the closing element 28 in the opening direction, each shear member 40 is no longer projecting into the closing element skirt aperture 74 and is no longer effective to positively resist the upward force being exerted by the lower portion of the skirt 50. When the shear members 40 no longer project into the skirt apertures 74, the closing element skirt 50, which has been elastically stretched in the axial direction, is now able to overcome any existing frictional engagement with the shear members 40, and can spring upwardly slightly (in the direction of arrows 130 in FIGS. 10A and 11A), and this causes the lower edges of the skirt apertures 74 to move upwardly past each shear member 40 as can be seen in FIGS. 10A and 11A.

In the preferred embodiment illustrated in FIGS. 1-11B, the action of a lower portion of the skirt 50 springing upwardly relative to each shear member 40 is preferably accompanied by a physical sensation that is felt by the user when the user rotates the closing element 28 to the open condition. The user may sense that the closing element 28 is "jumping up" or "popping up" or "snapping up" relative to the receiving structure 24. This sudden movement of the closing element 28 in the upward direction is preferred so as to provide the user with a further indication of the continuation of the opening process, but such a feature is not a required or essential feature of the broad aspects of the invention.

Figure 11:
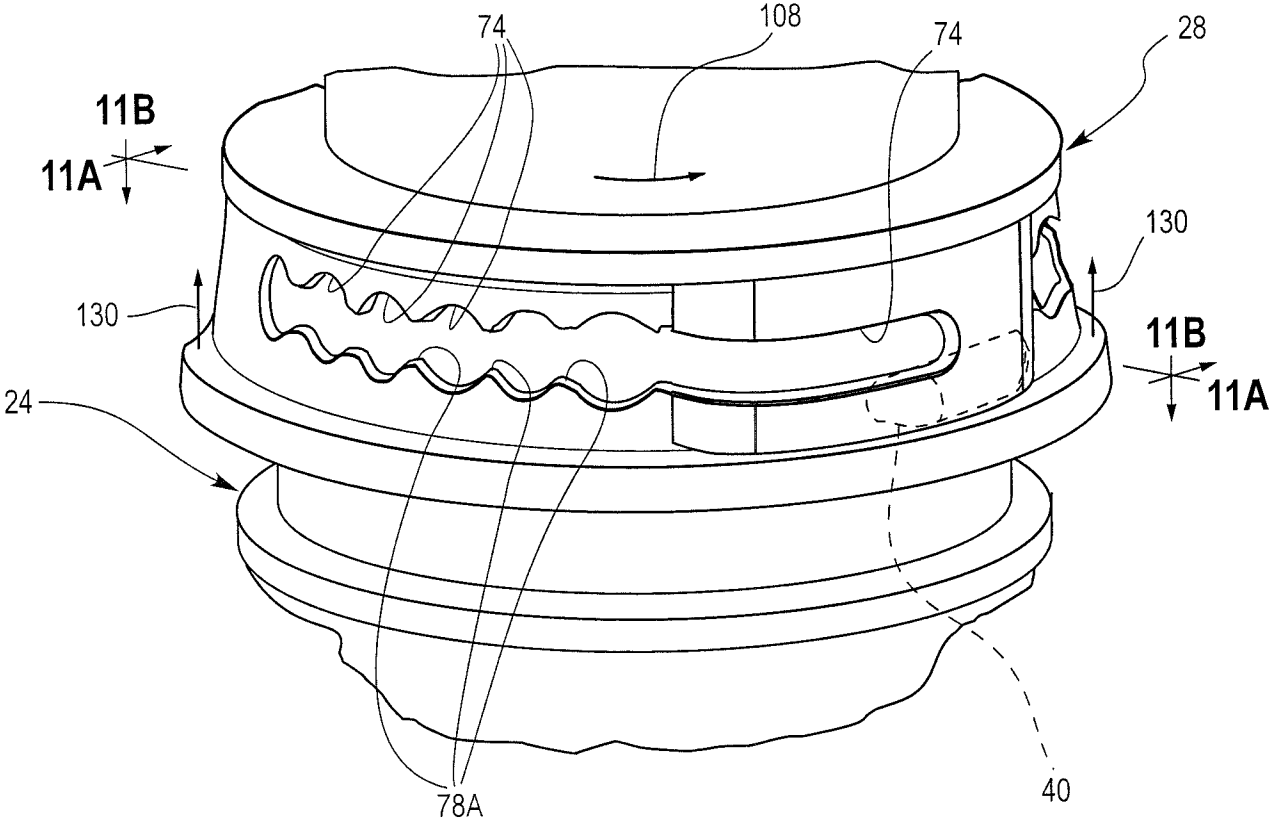
FIG. 11 is fragmentary, isometric view similar to FIG. 10, but in FIG. 11, the closing element has been rotated even further in the opening direction away from the initially fully assembled orientation.
Figure 11A:
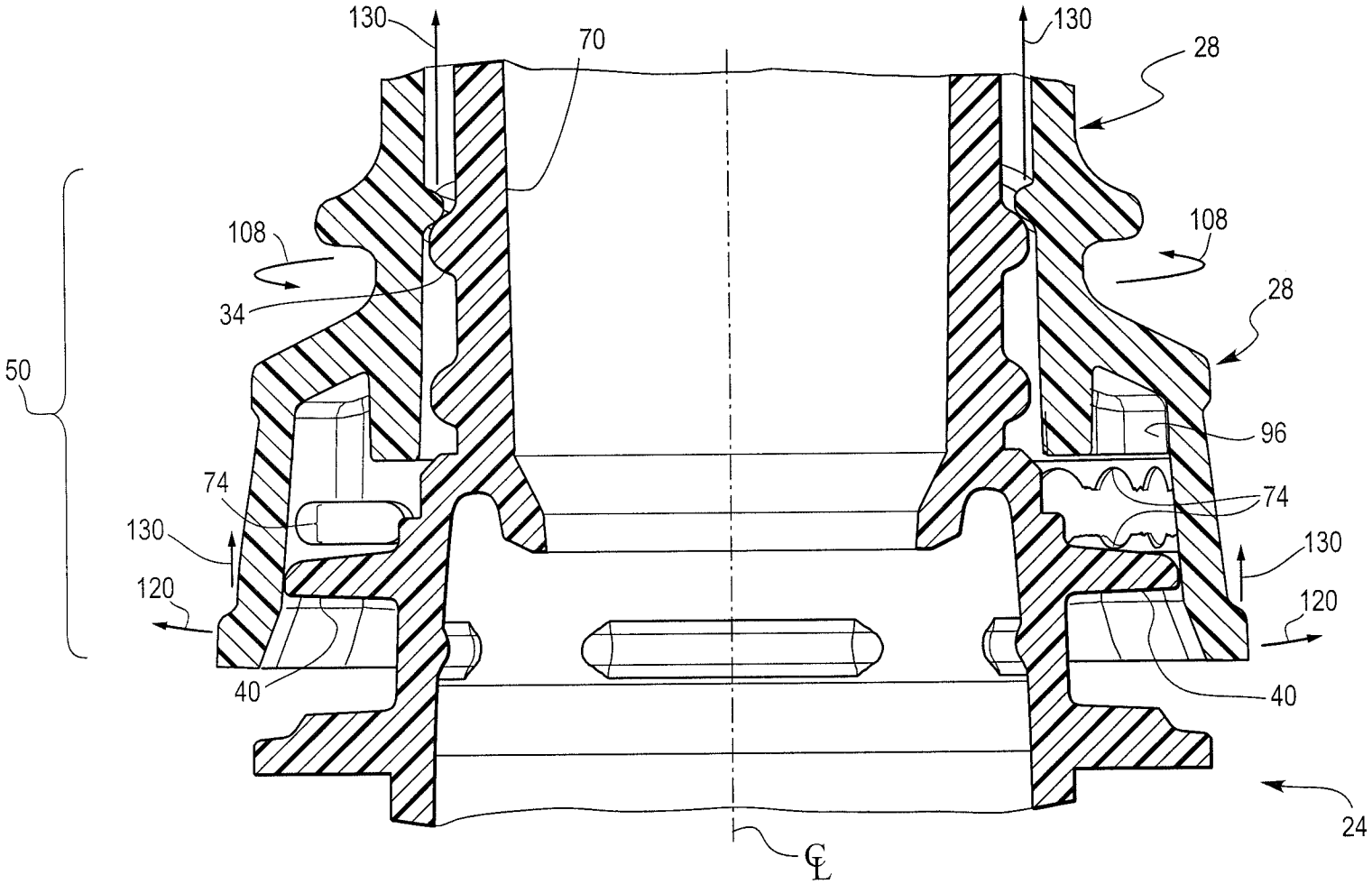
FIG. 11A is a fragmentary, cross-sectional view taken generally along the plane 11A-11A in FIG. 11.
Figure 11B:
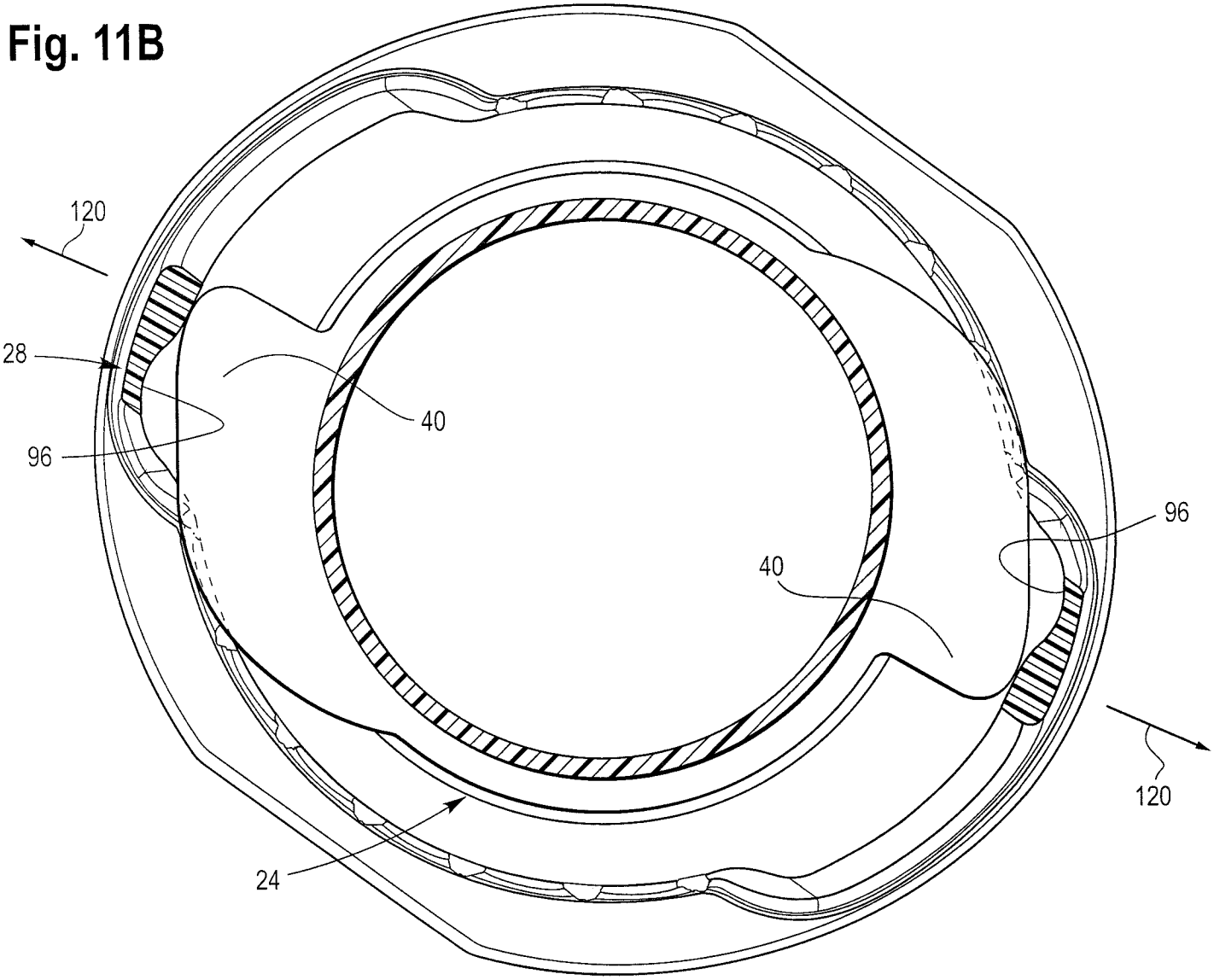
FIG. 11B is cross-sectional view taken generally along the plane 11B-11B in FIG. 11.

With reference to FIGS. 10 and 10A, 11 and 11A, as the user continues to rotate the closing element 28, each tether web 94 defining the recess 96 preferably remains outwardly distorted in the directions of the arrows 120, but is not torn or severed. Thus, the lower portion of the skirt 50 below the apertures 74 remains tethered (attached) to the portion of the skirt 50 above the apertures 74 even though all of the frangible bridges 78 have been severed. Thus, as can be seen in FIG. 11A, the portion of the skirt 50 that has been radially deformed in the direction of the arrows 120 can now be pulled upwardly together with the rest of the closing element 28 by the action of the closing element thread 70 in camming engagement with the thread 34 of the receiving structure 24. And, upon further rotation of the closing element 28, the closing element 28 is moved axially (i.e., translated) further up and along the spout 30. Eventually, the threads 34 and 70 become disengaged, and the entire closing element 28 can be lifted upwardly off of the receiving structure 24 to open the closure 20.

It will be noted that the trailing edge 44 of each shear member 40 is adapted for guiding the closing element skirt 50 as it rides up and around the shear members 40 during the relative axially upward movement of the closing element 28 as the closing element 28 is being rotated by the user.

Also, the trailing edge 44 of each shear member 40 can function to help guide the closing element 28 over the shear members 40 when the manufacturer initially installs the closing element 28 on the receiving structure 24.

The process for assembling the closing element 28 and the receiving structure 24 by the manufacturer could include the manufacturer merely pushing the closing element 28 down on the receiving structure 24 while both components are in proper rotational alignment for the initially assembled (closed) orientation (FIGS. 1-7), and the flexibility of the components, especially the flexibility of the closing element 28, would accommodate such an installation.

In another possible method of assembling the closure 20, the closing element 28 could also be rotated as it is being pushed down on the receiving structure 24 so as to engage the receiving structure thread 34 with the closing element thread 70—with the rotation being terminated at the point when the azimuthal (i.e., rotational) alignment between the two components corresponds to the fully closed, initially assembled orientation (FIGS. 1-7).

It will be appreciated that the combination of the closing element 28 and receiving structure 24 of the present invention can be designed to provide one or more different types of indications that the closing element 28 has been previously opened, or at least that an attempt was made to open the closing element 28.

It will also be appreciated that when the preferred embodiment of the closing element 28 is initially removed by the user from the receiving structure 24, the closing element frangible bridges 78 are severed, and the closing element lower end may remain (and preferably remains) radially distorted, but the closing element 28 also remains a unitary structure without any separate tear-off pieces or bands being generated by the opening process. As a result, there are no small, separate bits of the closing element 28 that could be a choking hazard for children or that would have to be separately recovered and retained for disposal. However, the structural and operational features of the preferred embodiment of the closure 20 which prevent the formation of smaller, separate, discrete waste pieces are not an essential requirement of the broad aspects of the invention.

In some applications, it may be desirable to design the closing element 28 so that after the closing element 28 has been opened and removed from the receiving structure 24, there remains some small amount of outward radial distortion or deformation along the lower edge of the skirt 50 which defines a somewhat elongate or oval shape (as viewed in plan from above or below). In other applications, it may not be desired to have a permanent deformation, and it may instead be desirable to design the closing element skirt 50 so that it generally remains with an original, undeformed attractive shape.

It will be appreciated that the number of the frangible bridges 78, and the openings defined between the frangible bridges 78, can be varied. In the preferred embodiment illustrated in FIGS. 1-11B, the frangible bridges 78 are provided in two sets or groups, with each group adapted to be severed by one of the two shear members 40. However, the frangible bridges 78 could be arranged in only one group or could be arranged in more than two groups. The number of frangible bridges 78 could vary from one to two or more. Also, although all the frangible bridges 78 have the same shape in the preferred embodiment, each frangible bridge 78 could have a shape that differs from the shapes of the other frangible bridges.

In an alternate form of the skirt 50 (not illustrated), the skirt 50 could include two generally cylindrical concentric sleeves joined together at their upper ends, for example, at or near the closing element top end portion 56.

Further, in such an alternate embodiment, the apertures 74 could be located higher up in the outer concentric sleeve of the skirt 50, for example, near the top end portion 56 of the closing element 28—above or adjacent the threads 70. In such an alternate arrangement, each shear member 40 could be joined to the receiving structure 24 below the inner concentric sleeve of the skirt with an L-shaped support member having a vertical leg extending upwardly between the inner and outer sleeves so as to locate the shear member in the elevated aperture 78.

With reference to FIG. 6, the preferred embodiment of the closing element 28 is illustrated as having an end portion 56 which, in combination with the other elements of the closure 20, prevents communication between the exterior environment and the interior closure 20 when the closure 20 is closed. However, the present invention contemplates that the closing element 28 could be modified so as to, among other things, include a dispensing orifice (not illustrated) in the end portion 56, and to include annular sealing features (not illustrated) on both the closing element 28 and receiving structure 24 such that when the closing element 28 is moved axially upwardly relative to the receiving structure 24, then such sealing features would function to prevent fluid leakage and accommodate dispensing of a fluent material from the interior of such a modified closure through such a dispensing orifice on the top of the closing element 28 and into the exterior environment. Such a closing element dispensing orifice and such annular sealing features on the closing element and the receiving structure are well known and are disclosed, for example, in U.S. Pat. Nos. 3,887,116; 5,680,969; 6,095,382; 6,290,108; 6,446,844; 6,513,681; and 6,739,781.

In yet another embodiment (not illustrated), the receiving structure thread 34 and closing element thread 70 could be eliminated altogether. In such an embodiment, the user would rotate the closing element 28 to sever the frangible bridges 78 and to position each closing element recess 96 and tether web 94 adjacent, and laterally deformed by, a shear member 40. Then the user would have to pull up on the closing element 28 to lift it off of the receiving structure 24.

The present invention can be summarized in the following statements or aspects numbered 1-13:

1. A combination of a closing element and a receiving structure which together in an initially assembled orientation prevent, but can be subsequently operated to permit, communication through the receiving structure, comprising:

said receiving structure that includes (A) at least one laterally projecting shear member; and (B) a spout defining an access passage; and said closing element having (A) an open end into which said receiving structure spout extends to accommodate relative rotation between said closing element and said receiving structure;

(B) an aperture for initially receiving said shear member when said closing element and receiving structure are in said initially assembled orientation; and (C) at least one frangible bridge extending across a portion of said aperture for being severed by said shear member during relative rotation between said closing element and receiving structure.

2. The combination in accordance with aspect 1 in which said combination can be operated to permit communication between the exterior and interior of a system through an opening in such a system; and in which said receiving structure is either: (A) a separate structure that can be attached to such a system at such a system opening and that defines said access passage through said receiving structure for communicating through such a system opening with the system interior; or (B) an integral structure that is a unitary portion of such a system and that includes said access passage through said integral structure to define such a system opening;

3. The combination in accordance with any of the preceding aspects in which said receiving structure is a body defining one said access passage; and said system is a container defining said system opening; and said body is separate from, but attached to, said container at said opening.

4. The combination in accordance with any of the preceding aspects in which said spout defines one of a cam and a cam follower;

said closing element includes a skirt defining (A) said open end, (B) the other of said cam and cam follower for engaging said one of said cam and cam follower on said receiving structure spout to effect relative axial movement between said receiving structure and said closing element, and (C) said aperture between said open end and said other of said cam and cam follower; and said cam and cam follower are arranged to accommodate a predetermined amount of relative rotation between said closing element and said receiving structure from said initially assembled orientation to cause said shear member to sever said at least one frangible bridge prior to initiation of relative axial movement between said closing element and said receiving structure.

5. The combination in accordance with the preceding aspect 4 in which said one of said cam and cam follower of said receiving structure is a thread; and said other of said cam and cam follower of said closing element is a thread in said closing element skirt.

6. The combination in accordance with any of the preceding aspects 4 and 5 in which said closing element skirt includes (1) a skirt upper portion defining said other of said cam and cam follower, and (2) a skirt lower portion that defines said aperture;

said closing element skirt includes a non-frangible, but deformable, tether web extending from above said aperture to below said aperture; and said non-frangible tether web defines a recess that (1) is radially inwardly open, and (2) axially open at said skirt open end.

7. The combination in accordance with any of the preceding aspects 4-6 in which said skirt defines a recess for receiving said shear member wherein said skirt is engaged by said shear member to effect radially outward deformation of said skirt to accommodate relative axial movement between said closing element and receiving structure.

8. The combination in accordance with any of the preceding aspects 4-7 in which said cam and cam follower are dual lead helical threads.

9. The combination in accordance with any of the preceding aspects in which said shear member projects laterally outwardly through said closing element aperture beyond the radial extent of said at least one frangible bridge when said receiving structure and said closing element are in said initially assembled orientation.

10. The combination in accordance with any of the preceding aspects in which said at least one frangible bridge has oppositely facing sides that each has a concave configuration.

11. The combination in accordance with any of the preceding aspects in which said receiving member includes two of said shear members diametrically opposed to each other, and said closing element defines two sets of a plurality of said frangible bridges wherein said two sets of said plurality of said frangible bridges are diametrically opposed to each other and wherein each set of said plurality of said frangible bridges is respectively engageable by one of said shear members.

12. The combination in accordance with any of the preceding aspects in which said closing element defines a plurality of said frangible bridges arranged in a circumferentially spaced-apart configuration for sequential severing by said shear member.

13. The combination in accordance with any of the preceding aspects in which said shear member includes (A) a leading edge for initially engaging said at least one frangible bridge, and (B) a trailing edge for guiding said closing element over said shear member during assembly of said closing element and said receiving structure.

The inventor has found that a closure embodying one or more features of the preferred embodiment of the invention can provide one or more novel ways of indicating that the closure has been opened or that tampering has occurred.

The inventor has also found that the closure of the present invention functions to provide operational advantages without undue operational complexity.

The inventor of the present invention has also found that with the preferred embodiment of the closure as illustrated, the components can be readily molded and easily assembled.

The inventor of the present invention has further found that the closure of the present invention can be implemented in designs that accommodate efficient, high quality, large volume manufacturing techniques with a low product reject rate.

It will be readily observed from the foregoing detailed description of the invention and from the illustrations thereof that numerous other variations and modifications may be effected without departing from the true spirit and scope of the novel concepts or principles of this invention.

What is claimed is:

1. A combination of a closing element and a receiving structure which together in an initially assembled orientation prevent, but can be subsequently operated to permit, communication through the receiving structure, comprising:

said receiving structure that includes (A) at least one laterally projecting shear member; and (B) a spout defining an access passage; and said closing element having (A) an open end into which said receiving structure spout extends to accommodate relative rotation between said closing element and said receiving structure;

(B) an aperture for initially receiving said shear member when said closing element and receiving structure are in said initially assembled orientation; and (C) at least one frangible bridge extending across a portion of said aperture for being severed by said shear member during relative rotation between said closing element and receiving structure; and wherein said at least one frangible bridge has oppositely facing sides that each has a concave configuration, and said at least one frangible bridge has a tapered configuration with a narrow middle portion located between a wider top end portion and a wider bottom end portion.

2. The combination in accordance with claim 1 in which each of said oppositely facing sides of said at least one frangible bridge has a continuously concave configuration.

3. The combination in accordance with claim 1 in which said closing element comprises a plurality of circular apertures separated by a plurality of frangible bridges.

4. The combination in accordance with claim 1 in which said closing element includes a skirt having a generally circular flange having two oppositely facing planar surfaces which are spaced about 180° apart.

5. The combination in accordance with claim 1 in which said closing element includes a plurality of tabs adapted to be engaged by a user's fingers and thumb, each tab defining an aperture therein.

6. The combination in accordance with claim 1 in which said closing element defines a plurality of said frangible bridges arranged in a circumferentially spaced-apart configuration for being sequentially severed by said shear member, wherein each one of said frangible bridges is configured to generate an audible click when severed by said shear member.

7. The combination in accordance with claim 1 in which said spout defines one of a cam and a cam follower;

said closing element includes a skirt defining (A) said open end, (B) the other of said cam and cam follower for engaging said one of said cam and cam follower on said receiving structure spout to effect relative axial movement between said receiving structure and said closing element, and (C) said aperture between said open end and said other of said cam and cam follower; and said cam and cam follower are arranged to accommodate a predetermined amount of relative rotation between said closing element and said receiving structure from said initially assembled orientation to cause said shear member to sever said at least one frangible bridge prior to initiation of relative axial movement between said closing element and said receiving structure.

8. The combination in accordance with claim 1 in which said shear member projects laterally outwardly through said at least one aperture beyond the radial extent of said at least one frangible bridge when said receiving structure and said closing element are in said initially assembled orientation.

9. The combination in accordance with claim 1 in which said at least one frangible bridge has the form of a plurality of frangible bridges, said aperture of said closing element has the farm of (i) an elongate aperture for receiving said shear member, and further has the form of (ii)

a plurality of circular apertures separated by said plurality of frangible bridges, said plurality of circular apertures extending around said closing element on either side of said elongate aperture.

10. The combination in accordance with claim 9 in which said elongate aperture has an oval shape.

11. The combination in accordance with claim 1 in which said closing element includes at least one non-frangible, but deformable, tether web, and wherein one of said concave sides of said at least one frangible bridge faces said tether web.

12. The combination in accordance with claim 1 in which said aperture of said closing element has the form of (i) an elongate aperture and further has the form of (ii) at least one circular aperture, said elongate aperture and said at least one circular aperture defining between them a non-frangible, but deformable, tether web.

* * * * *